US011904428B2

(12) United States Patent
Tsukanov et al.

(10) Patent No.: US 11,904,428 B2
(45) Date of Patent: Feb. 20, 2024

(54) SYSTEMS FOR BLADE SHARPENING AND CONTACTLESS BLADE SHARPNESS DETECTION

(71) Applicants: Vitaly Tsukanov, Lviv (UA); Yura Bashtyk, Lviv (UA); Ivan Romanyshyn, Lviv (UA); John R. Ellis, Arlington, MA (US)

(72) Inventors: Vitaly Tsukanov, Lviv (UA); Yura Bashtyk, Lviv (UA); Ivan Romanyshyn, Lviv (UA); John R. Ellis, Arlington, MA (US)

( * ) Notice: Subject to any disclaimer, the term of this patent is extended or adjusted under 35 U.S.C. 154(b) by 36 days.

(21) Appl. No.: 17/743,102

(22) Filed: May 12, 2022

(65) Prior Publication Data

US 2022/0274221 A1 Sep. 1, 2022

Related U.S. Application Data

(63) Continuation-in-part of application No. 16/877,061, filed on May 18, 2020, now Pat. No. 11,772,223.
(Continued)

(51) Int. Cl.
*B24B 3/54* (2006.01)
*B24B 49/12* (2006.01)

(52) U.S. Cl.
CPC ..... *B24B 3/54* (2013.01); *B24B 49/12* (2013.01)

(58) Field of Classification Search
CPC ..... G01N 29/0609; B24B 3/54; B24B 49/12
(Continued)

(56) References Cited

U.S. PATENT DOCUMENTS 5,899,792 A 5/1999 Yagi
6,633,379 B2 * 10/2003 Roesner ..... B24B 49/183 451/6
(Continued)

FOREIGN PATENT DOCUMENTS

CN 109238141 A * 1/2019 ..... G01B 11/00
DE 102010022273 A1 12/2011
(Continued)

OTHER PUBLICATIONS

CN-109238141-A, Translation (Year: 2023).*

*Primary Examiner* — Nhat Chieu Q Do
(74) *Attorney, Agent, or Firm* — Thomas P. O'Connell; O'Connell Law Firm

(57) ABSTRACT

A blade sharpening and blade sharpness detection system for permitting blade sharpening and a determination of blade sharpness without mechanical contact with the blade cutting edge. An optical inspection unit inspects blade sharpness optically, and a blade positioning and guidance mechanism positions and guides the blade in relation to the optical inspection unit. An output display provides visual output of blade sharpness. The optical inspection unit, which can be a reflective optical sensor, and the blade positioning and guidance mechanism are retained by a pivotable support structure. The positioning and guidance mechanism can comprise first and second pairs of rotatable spheres, each such pair disposed in immediate juxtaposition to act as rolling supports for the blade. The entry of ambient light into the sharpness sensing volume can be prevented by resiliently deflectable light-blocking bodies retained to first and second sides of a sharpness inspection slot within the housing.

14 Claims, 23 Drawing Sheets

Related U.S. Application Data

(60) Provisional application No. 62/966,306, filed on Jan. 27, 2020, provisional application No. 62/926,000, filed on Oct. 25, 2019.

(58) Field of Classification Search
USPC ..... 451/5
See application file for complete search history.

(56) References Cited

U.S. PATENT DOCUMENTS

| | | | | |
|---|---|---|---|---|
| 7,293,451 | B2 | 11/2007 | Dowd | |
| 8,915,766 | B1 * | 12/2014 | Kolchin | B24B 49/12 451/5 |
| 9,016,113 | B2 | 4/2015 | Newell et al. | |
| 9,651,466 | B2 | 5/2017 | Brown et al. | |
| 9,815,166 | B2 | 11/2017 | Goldstein et al. | |
| 2004/0211737 | A1 * | 10/2004 | Siegel | A47G 21/14 248/37.3 |
| 2006/0192939 | A1 | 8/2006 | Lebeau | |
| 2009/0209177 | A1 | 8/2009 | Walker | |
| 2011/0281503 | A1 | 11/2011 | Knecht et al. | |
| 2015/0009321 | A1 * | 1/2015 | Goldstein | B23Q 17/2409 348/135 |
| 2015/0258651 | A1 * | 9/2015 | Elek | B24D 15/08 451/45 |
| 2019/0012777 | A1 | 1/2019 | Crannell et al. | |
| 2019/0084113 | A1 | 3/2019 | Dovel | |
| 2019/0126423 | A1 | 5/2019 | Lyons et al. | |
| 2019/0210177 | A1 | 7/2019 | Graves et al. | |
| 2019/0358763 | A1 * | 11/2019 | Hessler | B24B 3/54 |

FOREIGN PATENT DOCUMENTS

| | | | |
|---|---|---|---|
| EP | 0866308 | A2 | 9/1998 |
| WO | WO2002086419 | A1 | 10/2002 |
| WO | WO2013102900 | | 7/2013 |

* cited by examiner

SYSTEMS FOR BLADE SHARPENING AND CONTACTLESS BLADE SHARPNESS DETECTION

RELATED APPLICATIONS

This application is a continuation-in-part of application Ser. No. 16/877,061, filed May 18, 2020, which claims priority to Provisional Application No. 62/926,000, filed Oct. 25, 2019, and Provisional Application No. 62/966,306, filed Jan. 27, 2020, each of which being incorporated herein by reference.

FIELD OF THE INVENTION

The present invention relates generally to knife and blade sharpness testing. More particularly, disclosed herein are methods and devices for inspecting blade cutting edge sharpness in a contactless manner and for blade sharpening, potentially in a unitary system, to permit ongoing inspection and verification of blade sharpness to maximize the ability to achieve a high level of blade sharpness while minimizing unnecessary material removal during rough and fine grinding and polishing. Further disclosed are mechanisms for blocking the entrance of ambient light into a sharpness sensing volume within the system to avoid the deleterious effects thereof on sharpness sensing.

BACKGROUND OF THE INVENTION

A well-performing knife or other bladed cutting instrument will have a sharp blade formed according to its purpose. A knife blade has a wedge angle, defined as the angle between the faces of the knife, and a bevel angle, which may alternatively be referred to as a cutting edge angle, comprising the angle between the actual cutting facets. A cleaver or machete, commonly used for chopping, might have a cutting edge angle in the range of 35 to 40 degrees. However, a chef's knife must be sharpened to have a cutting edge angle more in the range of 25 to 30 degrees.

Many tools and methods for sharpening cutting blades have been disclosed by the prior art. Perhaps the most traditional methods for blade sharpening have been the whetstone and the honing rod where a user must carefully dispose the blade at a desired sharpening angle, which is one-half of the bevel angle in a typical blade, in relation to the sharpening surface of the whetstone or honing rod. However, establishing and maintaining the desired sharpening angle during the sharpening process can be challenging so that the results are often inconsistent and haphazard.

Other sharpening tools have been disclosed with sharpening elements retained at predetermined angles to permit sequential stages of sharpening. Rough grinding can be followed by fine grinding, which in turn can be followed by rough and fine polishing. A series of sharpening elements thus enable the sequential improvement of sharpness.

Unfortunately, during the sharpening process, it is difficult to ascertain the sharpness of a given blade. It is equally challenging to determine the sharpness of portions of the blade in relation to other portions of the blade. For instance, a portion of the blade may be sufficiently sharpened to move from one stage to the next, such as to finer grinding or polishing, while another portion of the blade may still require further sharpening. More generally, determining when a user should move from one stage of the sharpening process to the next, such as to a stage of finer grinding or to polishing, can be difficult, particularly for the typical home user.

Improperly advancing from one sharpening stage to the next can result in the excess removal of metal from the blade and increased blade processing time. Continuing rough grinding of a blade or a portion of the blade where it is already ready for fine grinding wears the blade unnecessary, but moving to fine grinding when further rough grinding is needed consumes excess time and effort. Moreover, continuing to focus on a portion of the blade that is already sufficiently prepared in a given stage of sharpening leads to unnecessary material removal at that portion just as failing to focus on a portion of the blade that requires further finishing leads to uneven results and wasted time. The relative complexity of blade sharpening and the inability to verify blade sharpness during the sharpening process contribute to poor results and increased user uncertainty and confusion.

Sharpness, particularly during intermediate stages of sharpening, is often estimated by different haptic methods or by measuring the force required to cut through test objects, such as paper, rope, felt, thread, or gelatin gel or based on predetermined instructions as to the number of cycles needed to complete the process.

Disadvantageously, haptic estimation of sharpness is very subjective. It provides only qualitative or relative results. Usually, only a skilled person can apply this method correctly. Cutting through test objects can itself present a danger to the user and requires access to sufficient testing substrate. Still further, predetermined instructions are often not matched to the actual condition of a given blade. Each method may improperly focus only on one or more specific portions of a blade while other portions may not match the sharpness condition of the tested portion.

More advanced sharpness testing systems have been disclosed for determining sharpness using quantitative terms based on the force required to produce a cut in a test object. In this regard, one may have reference to the systems taught by U.S. Pat. Nos. 9,651,466, 7,293,451, and 9,016,113. Such systems, however, require a separate device, and they assume the proper contact between the sharp edge and the test object, which increases probability of damaging or distorting the cutting edge by the very object that is designed to test it. This issue is particularly critical for very fine sharp cutting tools, such as cytological microtome knives or cutting implements for ophthalmology and neurosurgery.

The prior art has also disclosed contactless optical methods for sensing the condition of an instrument, such as those described in European Patent No. EP0866308A3, International Publication Nos. WO2013102900A1 and WO2002086419A1, and U.S. Patent Application Publication No. 20060192939A1. Unfortunately, these too suffer from important limitations. For example, while it describes a receptor slot for a blade, Lebeau's Optical Sharpness Meter of Publication No. 20060192939A1 does not teach how a blade can be engaged or moved in relation to the slot without deleteriously impacting the blade's sharpness. International Publication No. WO2013102900A1 teaches a system for optically sensing the wear condition of mechanical instruments, but it too has no contemplation of blade inspection in a manner that permits the known retention and advancement of a blade in relation to the detection system. Still further, European Patent No. EP0866308A3 teaches an apparatus for determining the profile of an object, such as an edge on an aircraft engine blade, but it does not teach how a knife blade might be engaged and advanced in a sharpness detection system.

It is, therefore, apparent that there is a longstanding need for a device capable of testing the sharpness of the entirety of a blade during the sharpening process in a manner that permits known positioning and guided adjustment of the position of a blade without adverse impact on a blade edge. It is further apparent that a system permitting blade sharpness testing and effective blade sharpening in a single unit would represent a marked advance in the art.

Furthermore, having devised of a system for sharpening a blade and for testing blade sharpness in a single apparatus, the present inventors have further recognized that the entrance and reflection of ambient light into and within a sharpness testing apparatus has deleterious effects of the ability to measure sharpness optically. Particularly when the cutting edge of a blade is very sharp, the light returned to an optical sharpness sensor becomes increasingly weak. Ambient light entering the apparatus, such as through a slot provided to receive the blade for sharpness inspection, and light scattered and reflected within the apparatus tend to distort the results of the sharpness measurement.

Based on the foregoing, the inventors have discovered that it would be advantageous to prevent ambient light from entering the inner volume of the sharpness sensing volume while permitting the blade to enter the same for sharpness testing. The inventors have further discovered that it would be advantageous to prevent or limit the reflectance and scattering of any light that may exist within the sharpness sensing volume.

SUMMARY OF THE INVENTION

In view of the state of the prior art as summarized above, embodiments of the present invention have as an object thereof providing a system capable of detecting the sharpness of a cutting blade in a manner that provides accurate positioning and guidance to the blade while permitting the avoidance of mechanical contact between the cutting edge and the guidance mechanism once the cutting blade is inserted into the guidance mechanism.

A more particular object of embodiments of the invention is to provide a blade positioning and guidance system for optical inspection by an optical inspection unit that accurately positions a blade in a relatively movable manner.

A related object of manifestations of the invention is to enable the continuous inspection of blade sharpness over a length of a blade through accurate, movable blade positioning in relation to an optical inspection unit.

In certain embodiments of the invention, an object is to enable both optical sharpness inspection and grinding and sharpening in a single device.

A further object of the invention is to enable blades to be sharpened in an effective and efficient manner while avoiding unnecessary material removal.

In embodiments of the invention, yet another object is to prevent ambient light from entering the inner volume of the sharpness sensing volume while nonetheless permitting the blade to enter the same for sharpness testing.

An even further object of manifestations of the invention is to prevent or limit the reflectance and scattering of any light that may exist within the inner volume of the apparatus provided for optical inspection.

These and in all likelihood further objects and advantages of the present invention will become obvious not only to one who reviews the present specification and drawings but also to those who have an opportunity to make use of an embodiment of the system for blade sharpening and contactless blade sharpness detection disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

One embodiment of the invention can be characterized as a blade sharpness detection system for determining a sharpness of a blade. The system has an optical inspection unit operative to inspect blade sharpness optically and a blade positioning and guidance mechanism disposed to position and guide the blade in relation to the optical inspection unit. Under this construction, the blade can be positioned by use of the blade positioning and guidance mechanism, and the sharpness of the blade in a position localized to the optical inspection unit can be inspected by the optical inspection unit. Embodiments of the blade sharpness detection system can further include an output display operative to provide a visual output of the sharpness of the blade in the localized position.

The sharpness detection system can further include a housing, and the optical inspection unit and the blade positioning and guidance mechanism can be retained by the housing. Furthermore, a blade sharpening mechanism can be retained by the housing such that the blade can be both sharpened and positioned and guided for optical inspection of blade sharpness.

According to embodiments of the invention, the optical inspection unit and the blade positioning and guidance mechanism can be retained by a pivotable support structure that is pivotable about a pivot axis in relation to a pivot support cradle. In certain practices of the invention, for instance, the support structure can have first and second opposed walls separated by a guidance and sensing channel. The optical inspection unit can be in optical communication with the guidance and sensing channel, such as by projecting through an aperture in the base thereof, and the blade positioning and guidance mechanism can be disposed within the guidance and sensing channel spaced from the optical inspection unit. In particular embodiments, the optical inspection unit comprises a reflective optical sensor with an optical pair comprising a light emitter and a photodetector.

In practices of the invention, the blade positioning and guidance mechanism comprises a rolling support mechanism retained spaced from the optical inspection unit. In one such embodiment, the positioning and guidance mechanism comprises first and second rotatable, arcuate surfaces disposed in immediate juxtaposition spaced from the optical inspection unit. Those rotatable, arcuate surfaces can, for instance, comprise surfaces of rotatable spheres that are disposed in a pair in immediate juxtaposition and that are rotatable about a common axis. For instance, the first and second rotatable spheres can be pressed into direct contact at a point of contact, and reference to immediate juxtaposition herein shall be read to include such direct contact. In still more particular embodiments, the blade positioning and guidance mechanism comprises first and second pairs of rotatable spheres with those pairs retained in spaced relation to one another and in relation to the optical inspection unit. For example, the pairs of spheres can be disposed in corresponding positions distally and laterally spaced from the optical inspection unit such that the optical inspection unit is centered between and proximal to the pairs of spheres.

Other embodiments of the invention can be characterized as a blade sharpening and blade sharpness detection system for permitting not only a sharpening of a blade but also a determination of a sharpness of a blade. Such a system can comprise a housing that retains a blade sharpening mechanism, an optical inspection unit operative to inspect blade sharpness optically, and a blade positioning and guidance mechanism disposed to position and guide the blade in relation to the optical inspection unit. An output display can again provide a visual output of the sharpness of the blade in the localized position.

Embodiments of the invention for a blade sharpness detection system are further disclosed wherein an optical inspection unit operative to inspect blade sharpness optically and a blade positioning and guidance mechanism disposed to position and guide the blade in relation to the optical inspection unit are retained within a sharpness sensing volume within a housing. A sharpness inspection slot is disposed in the housing in alignment with the optical inspection unit and the blade positioning and guidance mechanism, and first and second light-blocking bodies are retained in opposition by the blade sharpness detection system to prevent passage of ambient light through the sharpness inspection slot and into the sharpness sensing volume. The first and second light-blocking bodies are adapted to receive the blade therebetween. Under this construction, a blade can be positioned in relation to the optical inspection unit by use of the blade positioning and guidance mechanism, and the sharpness of the blade in a position localized to the optical inspection unit can be inspected by the optical inspection unit while the otherwise deleterious effects of ambient light on sharpness inspection are prevented. For avoidance of doubt, the prevention of the entry of all ambient light, although, certainly desirable, is not required within the scope of the claims.

According to such embodiments, the first light-blocking body can be retained to a first side of a centerline of the sharpness inspection slot while the second light-blocking body is retained to a second side of the centerline of the sharpness inspection slot. The first and second light-blocking bodies can, for instance, be fixed to the housing in opposition. For instance, where the housing is considered to have an interior surface and an exterior surface, the first and second light-blocking bodies can be fixed to the interior surface of the housing to the first and second sides of the centerline of the slot. In other practices of the invention, the optical inspection unit and the blade positioning and guidance mechanism are retained by a pivotable support structure that is pivotable about a pivot axis, and the first and second light-blocking bodies are fixed to the pivotable support structure. With this, the first and second light-blocking bodies pivot with the pivotable support structure.

Each light-blocking body can have a resiliently deflectable light-blocking wing portion that extends toward a centerline of the sharpness inspection slot, such as at an oblique angle. The light-blocking wing portions of the light-blocking bodies can thus be disposed to form a V-shape for receiving the blade therebetween. Through their resiliency, the wing portions tend to adhere tightly to the side surfaces of the blade while allowing the acceptance of blades with different thicknesses. Each light-blocking body can further comprise a base portion fixedly retained by the blade sharpness detection system and a flex formation interposed between the base portion and the light-blocking wing portion. In constructions where the optical inspection unit and the blade positioning and guidance mechanism are retained by a pivotable support structure that is pivotable about a pivot axis, the base portions of the first and second light-blocking bodies can be fixed to the pivotable support structure so that the first and second light-blocking bodies pivot with the pivotable support structure.

Also as disclosed herein, the light-blocking wing portions of the light-blocking bodies can be considered to terminate in distal blade-engaging edges, and those blade-engaging edges correspond in shape. By way of example, the blade-engaging edges of the light-blocking wing portions of the light-blocking bodies can have at least portions thereof that are straight and that tend to meet at the centerline of the sharpness inspection slot.

Pursuant to embodiments of the invention, the optical inspection unit and the blade positioning and guidance mechanism can be retained by a support structure with first and second opposed walls separated by a guidance and sensing channel. The optical inspection unit can be in optical communication with the guidance and sensing channel, and the blade positioning and guidance mechanism can be disposed within the guidance and sensing channel spaced from the optical inspection unit. The sharpness sensing volume can be considered to envelop the optical inspection unit and the blade positioning and guidance mechanism.

Still further, it is disclosed that, where the first and second light-blocking bodies are retained within the housing and the housing is considered to have an interior shape proximal to the first and second light-blocking bodies, the first and second light-blocking bodies can have first and second ends that are shaped and positioned to correspond to the interior shape of the housing proximal to the first and second light-blocking bodies. With this, ambient light is further prevented from entering the sharpness sensing volume. In certain such examples, the optical inspection unit and the blade positioning and guidance mechanism can be retained by a pivotable support structure that is pivotable about a pivot axis and the first and second light-blocking bodies can be fixed to the pivotable support structure to pivot with the pivotable support structure. Where the housing has an arcuate upper cross-sectional shape, the first and second ends of the light-blocking bodies can then have shapes corresponding thereto, such as by having first and second ends that are outwardly sloped and contoured in shape in correspondence to the cross-sectional shape of the housing.

The first and second light-blocking bodies can be resiliently deflectable thereby to permit reception of a blade therebetween without hindering longitudinal movement of the blade for blade inspection. For instance, the first and second light-blocking bodies can be formed from a resiliently deflectable material, such as a resiliently deflectable metal or plastic, a resiliently compressible foam, a brush material, or any other resiliently deflectable material capable of blocking light.

It is additionally disclosed that the surfaces within the sharpness sensing volume can be coated or treated to absorb light thereby to prevent the scattering and reflectance of any light that does enter the sharpness sensing volume. For example, the surfaces within the sharpness sensing volume can be coated with a light-absorbing coating. Additionally or alternatively, they could be surface treated to promote light absorption and to limit light reflectance and scattering.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The systems for blade sharpening and contactless blade sharpness detection disclosed herein are subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

The systems for blade sharpening and contactless blade sharpness detection disclosed herein may be employed to great advantage where blade sharpening and blade sharpness detection are enabled in a single device. However, it is to be understood that contactless blade sharpness detection systems according to the invention could be employed independently and that the present blade sharpening system could be exploited in combination with differently embodied blade sharpness detection systems or vice versa. The scope of the invention shall be limited only as may be expressly required by the claims. Before any particular embodiment of the invention is explained in detail, it must be made clear that the following details of construction and illustrations of inventive concepts are mere examples of the many possible manifestations of the invention.

Figure 24C:
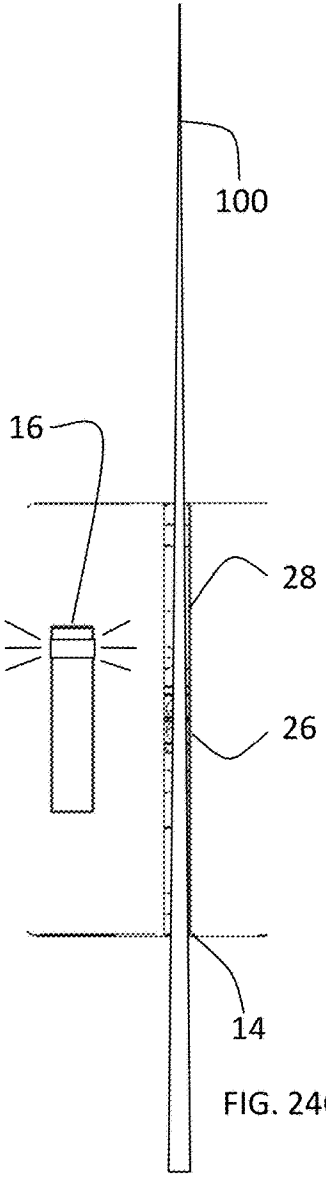
FIGS. 24A through 24C are top plan views depicting the sensing of varying levels of blade sharpness during blade sharpening according to the present invention.
Figure 24B:
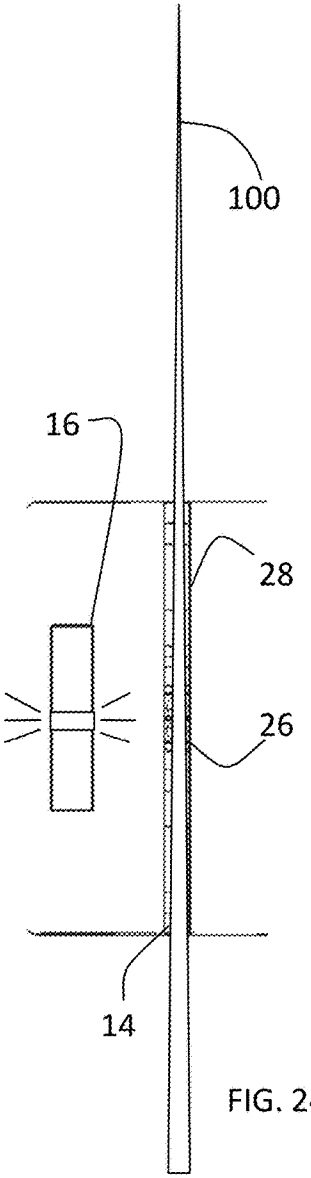
Figure 24A:
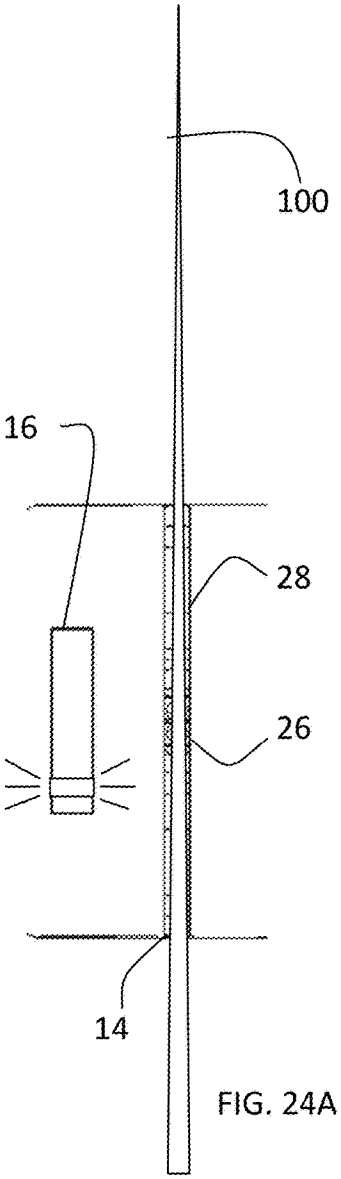

Turning more particularly to the drawings, a system for blade sharpening and contactless blade sharpness detection according to the present invention is indicated generally at 10 in FIGS. 1 through 4. There, the sharpening and sharpness detection system 10 may be considered to be founded on a housing with a housing cover 12. A sharpness inspection slot 14 is disposed laterally through the housing cover 12 for receiving a blade 100 as is shown, for instance, in FIGS. 24A through 24C. As is described further hereinbelow, an optical inspection unit 26 is retained within the inspection slot 14, and a blade positioning and guidance mechanism 28 is disposed to position and guide the blade 100 in accurate relation to the optical inspection unit 26, which may alternatively be referred to as an optical sharpness sensor. An output display 16 is retained to be viewed in relation to the housing cover 12 to provide a visual output of a localized sharpness of the blade 100 as sensed by the optical inspection unit 26. Operation of the sharpening and sharpness detection system 10 can be automatic, or it can be user-actuated, such as by the pressing of a power button 24. The sharpening and sharpness detection system 10 further incorporates a blade sharpening mechanism that is retained within the housing cover 12 for grinding and polishing the blade 100 to a desired sharpness. So constructed, the sharpening and sharpness detection system 10 is capable not only of grinding and sharpening a given blade 100 but also of accurately positioning and guiding the blade 100 for contactless optical inspection as to its localized sharpness over the length of the blade 100.

Figure 1:
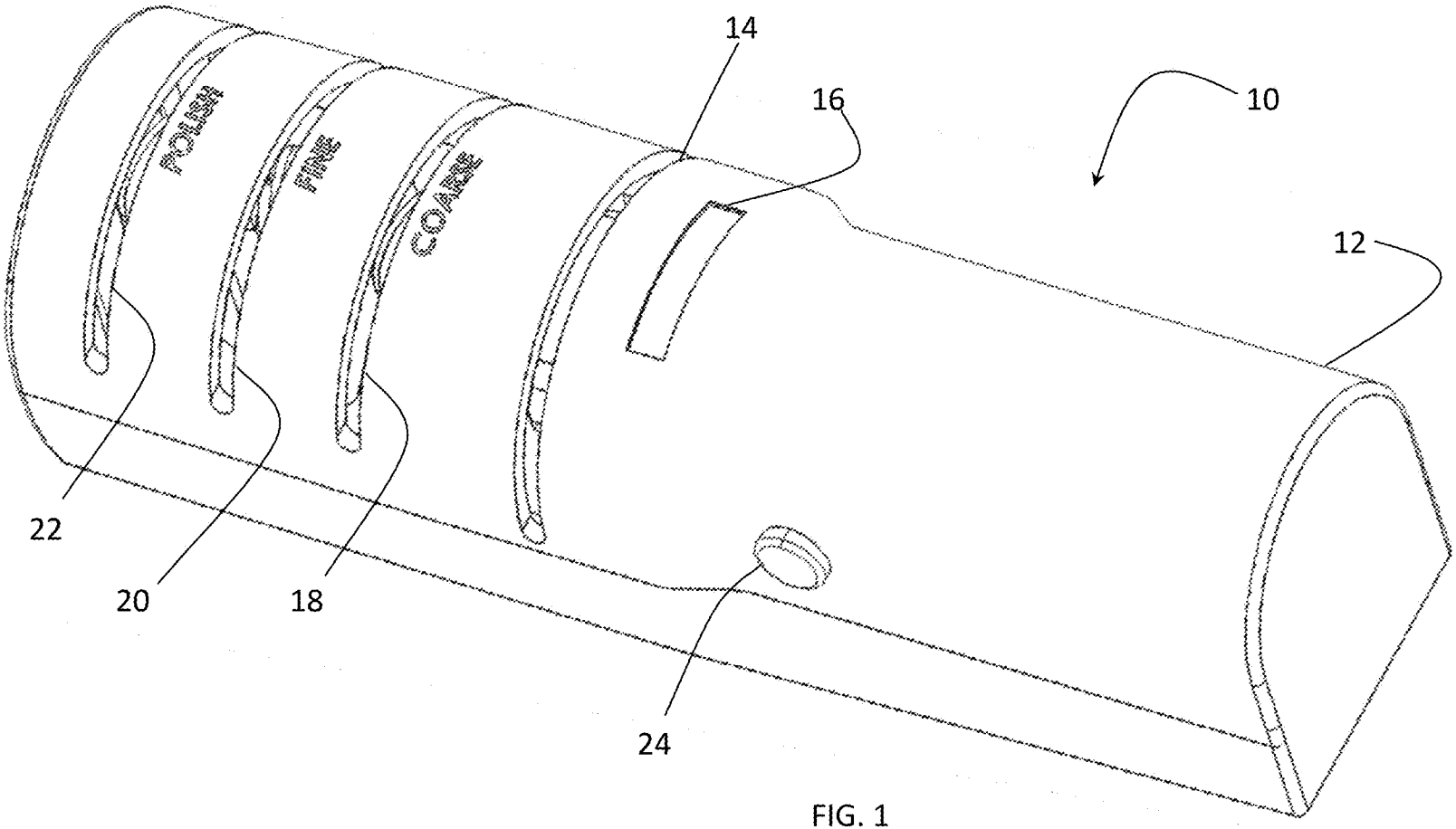
FIG. 1 is a perspective view of a system for blade sharpening and contactless blade sharpness detection according to the present invention.
Figure 2:
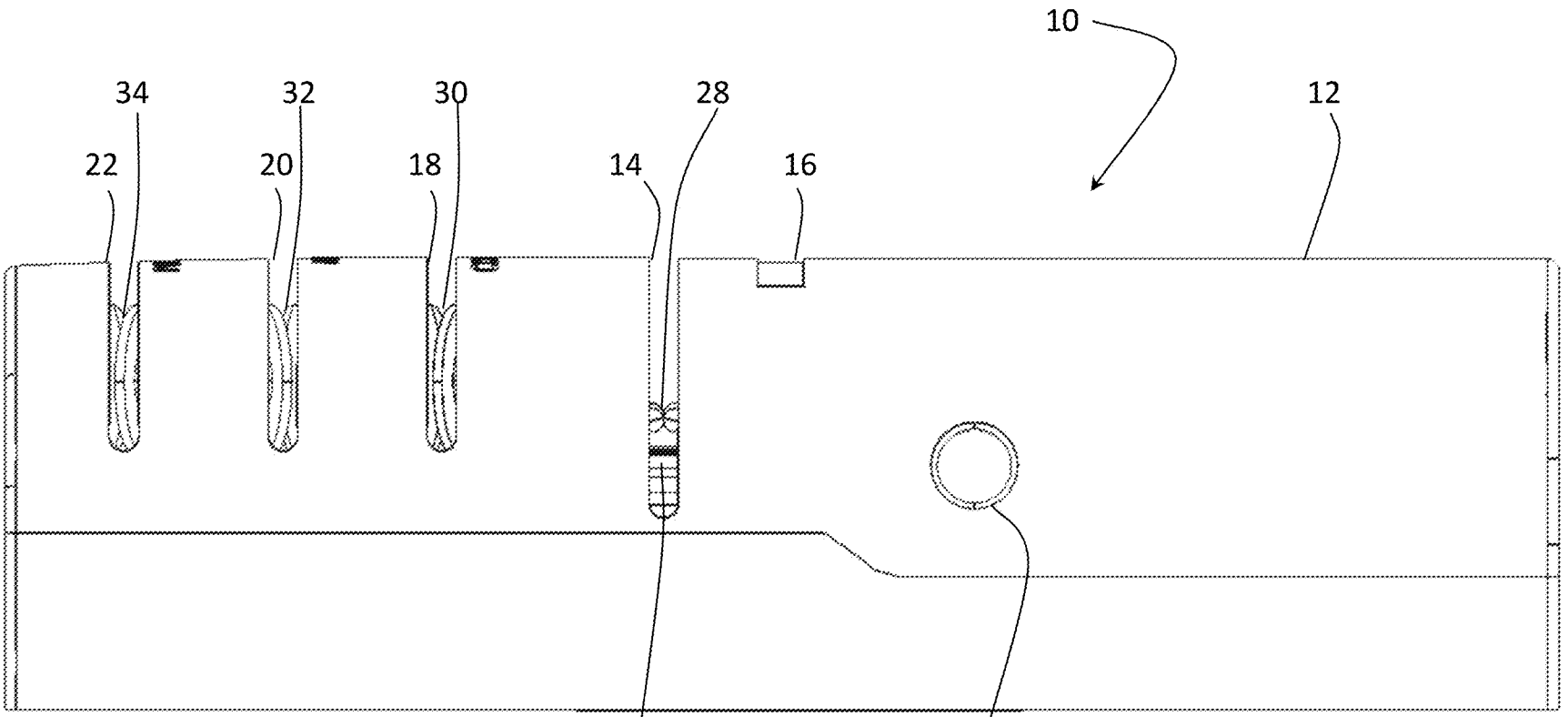
FIG. 2 is a view in side elevation of the system for blade sharpening and contactless blade sharpness detection.
Figure 3:
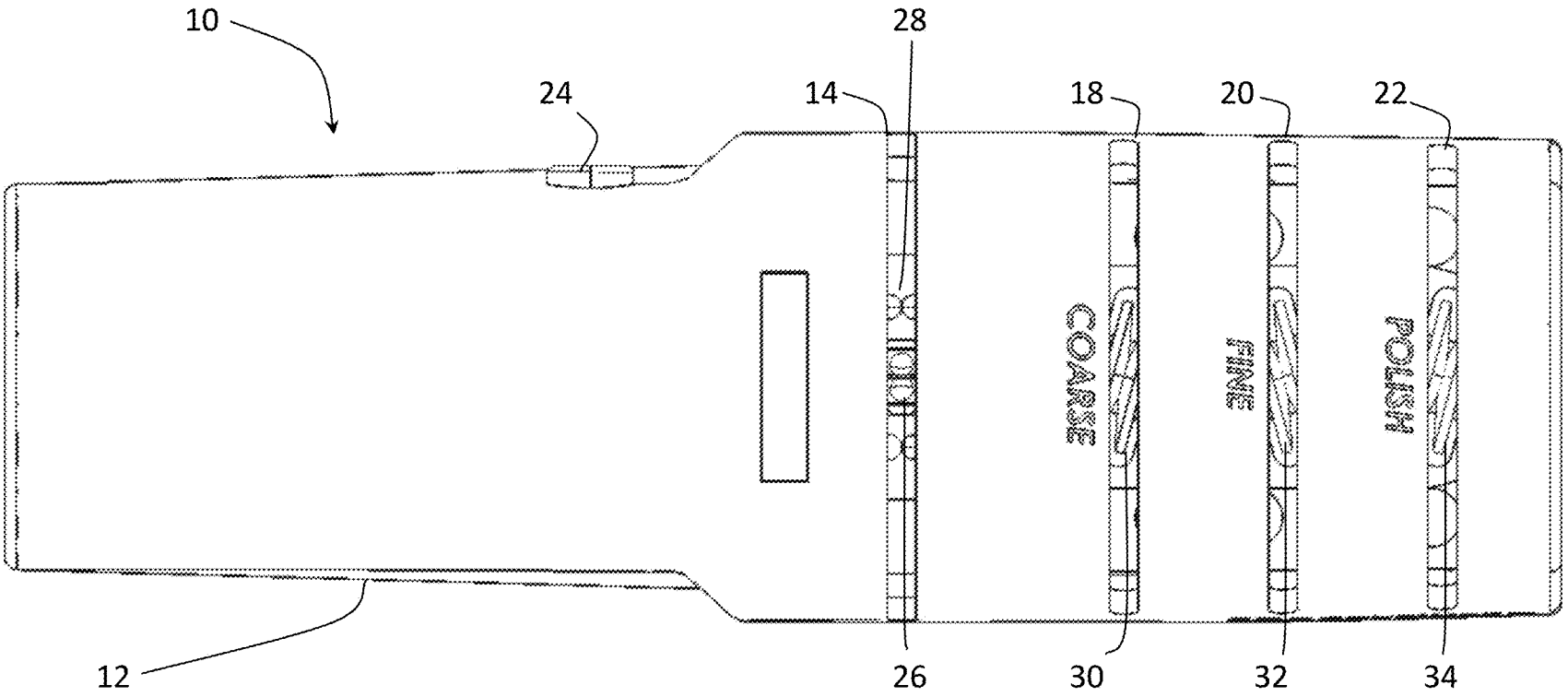
FIG. 3 is a top plan view of the system for blade sharpening and contactless blade sharpness detection.
Figure 4:
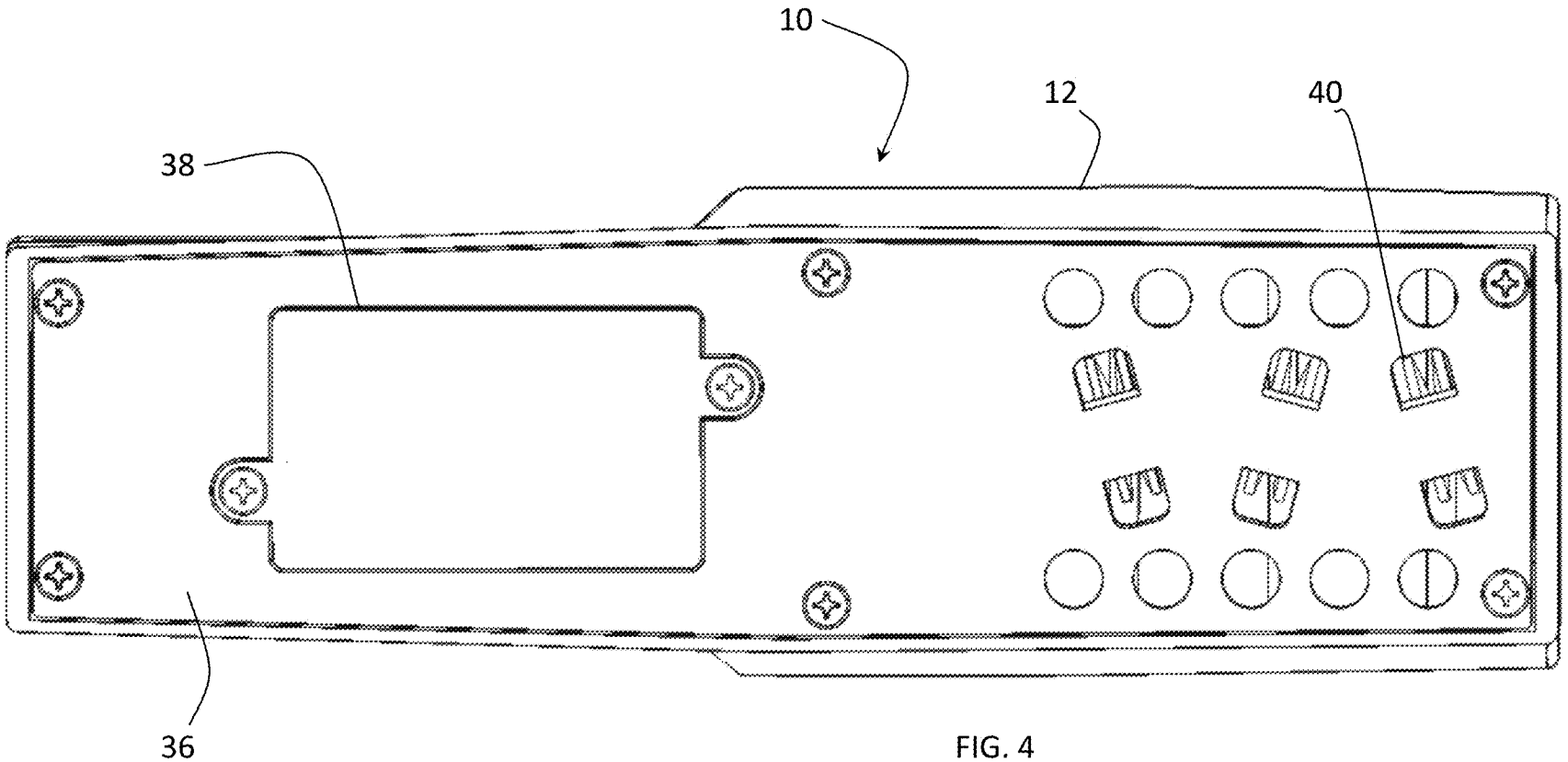
FIG. 4 is a bottom plan view of the system for blade sharpening and contactless blade sharpness detection.
Figure 5:
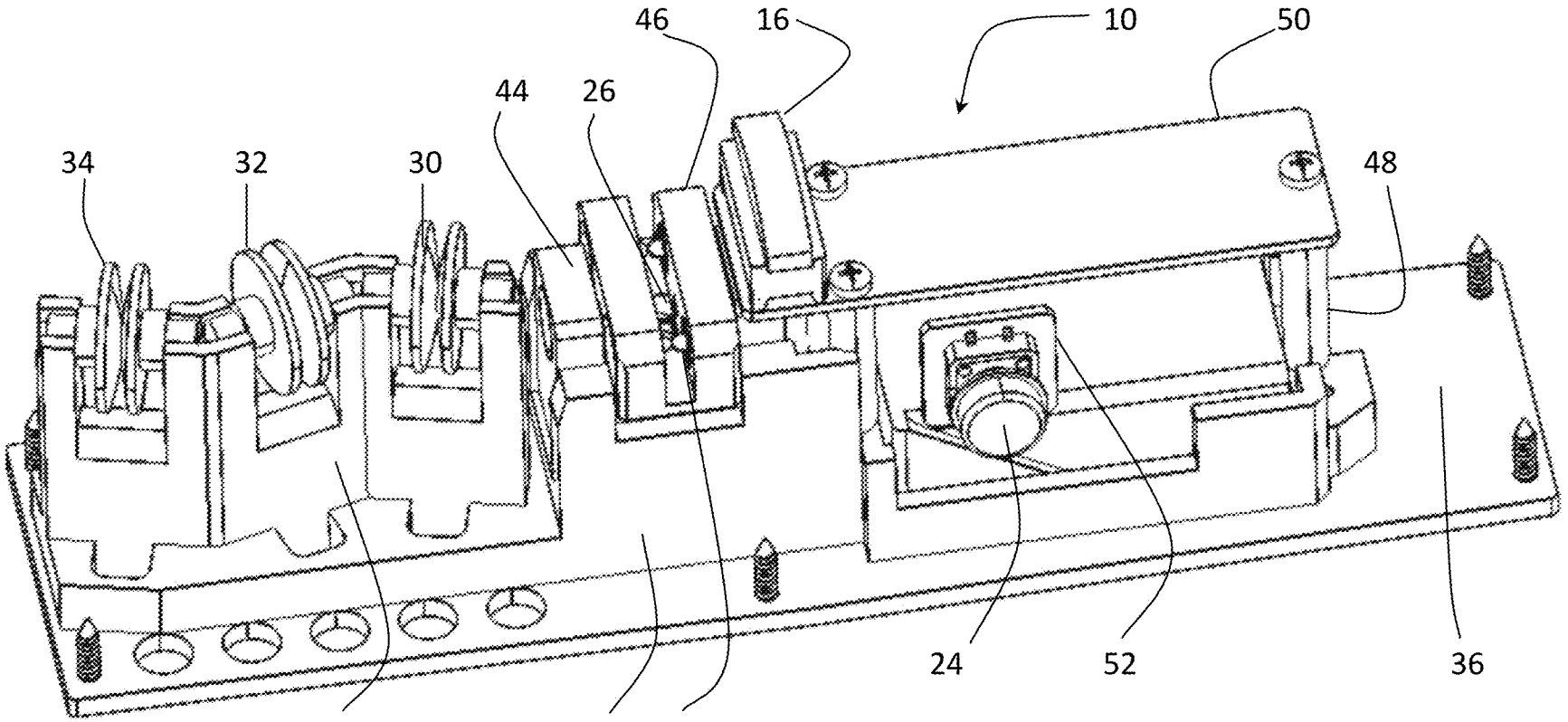
FIG. 5 is a perspective view of the system for blade sharpening and contactless blade sharpness detection.
Figure 6:
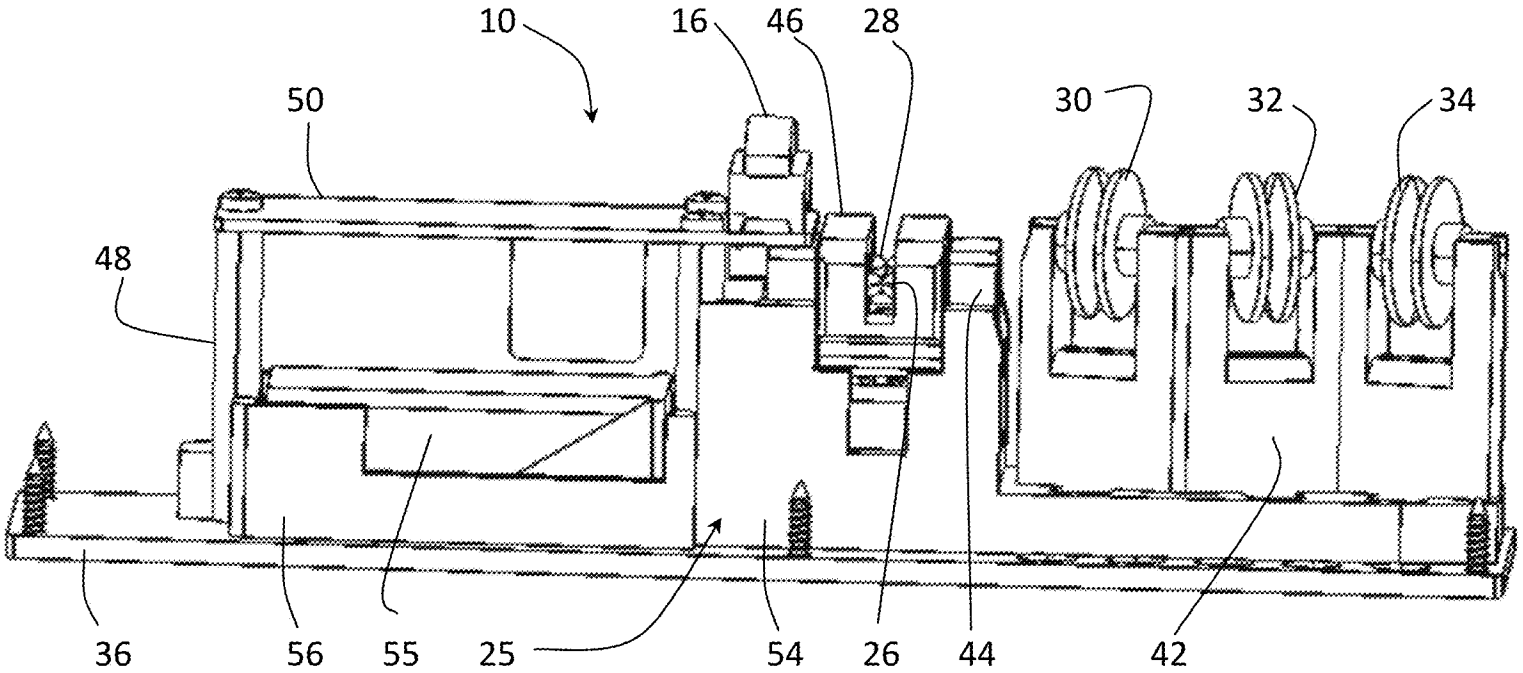
FIG. 6 is an alternative perspective view of the system for blade sharpening and contactless blade sharpness detection, again with the cover removed.
Figure 7:
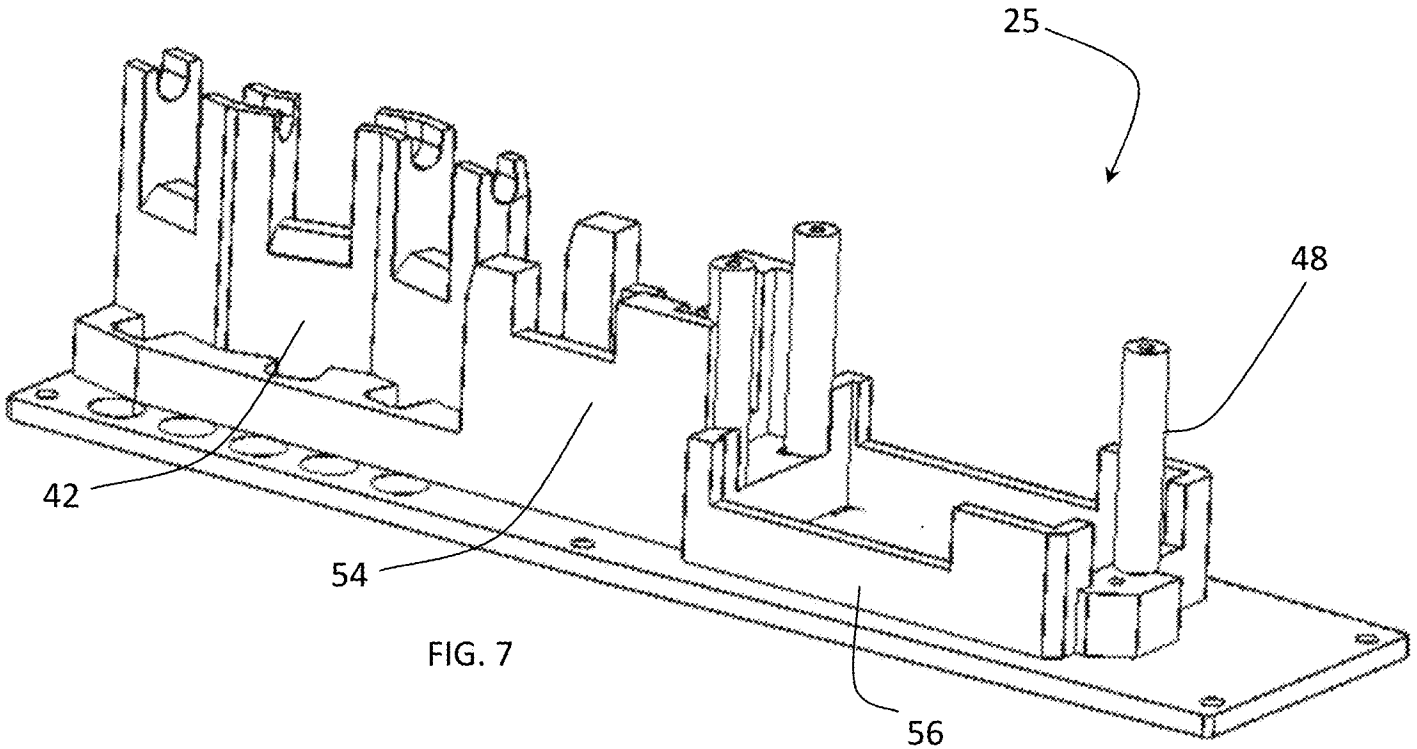
FIG. 7 is a perspective view of the base structure of the system for blade sharpening and contactless blade sharpness detection.
Figure 8:
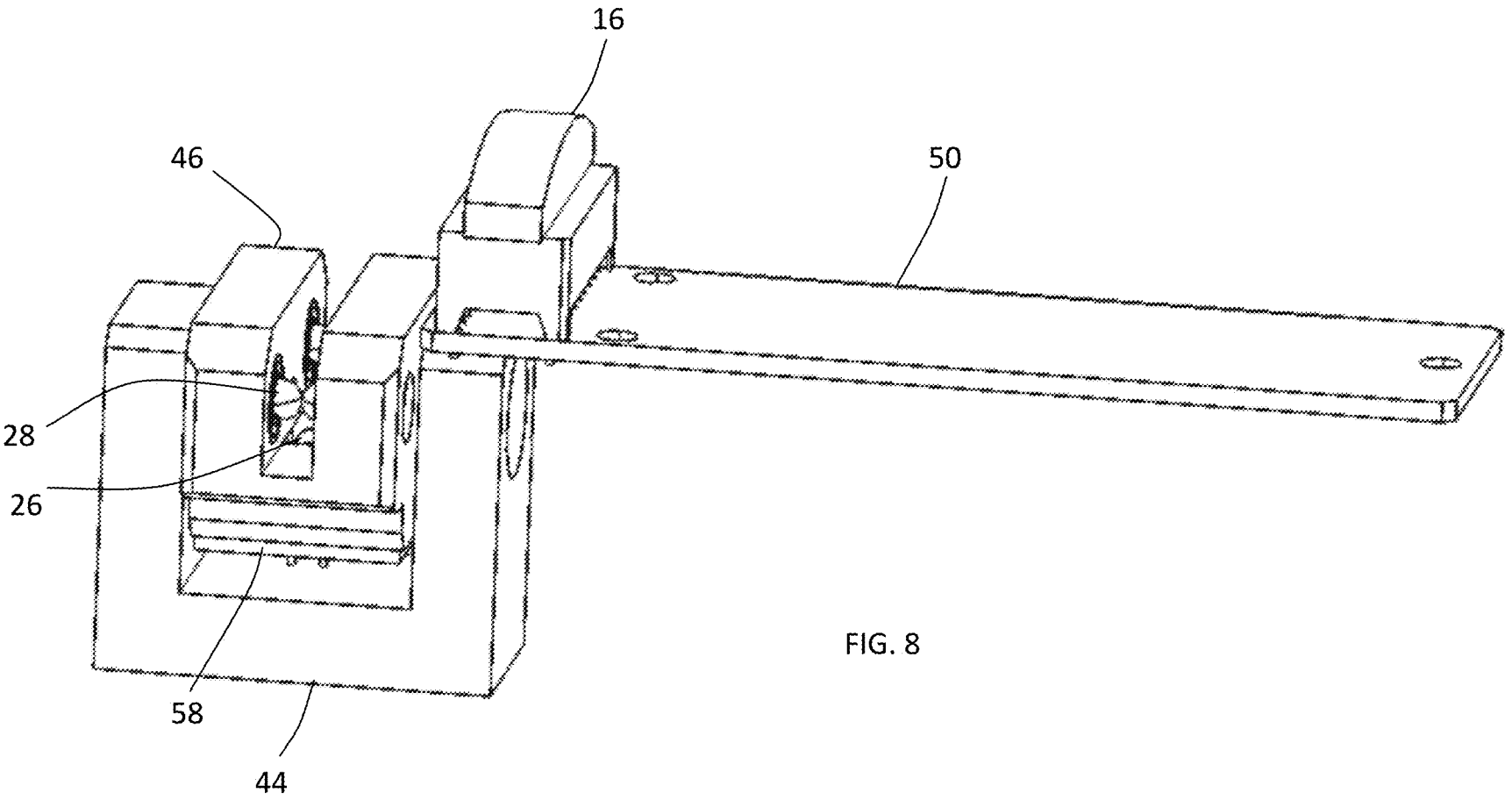
FIG. 8 is a perspective view of a sharpness testing system according to the invention with a sharpness indicating display.
Figure 10:
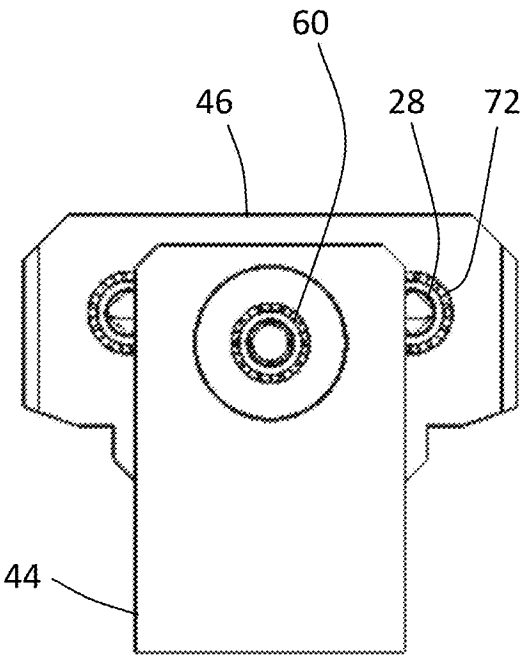
FIG. 10 is a view in side elevation of the sharpness testing system.
Figure 9:
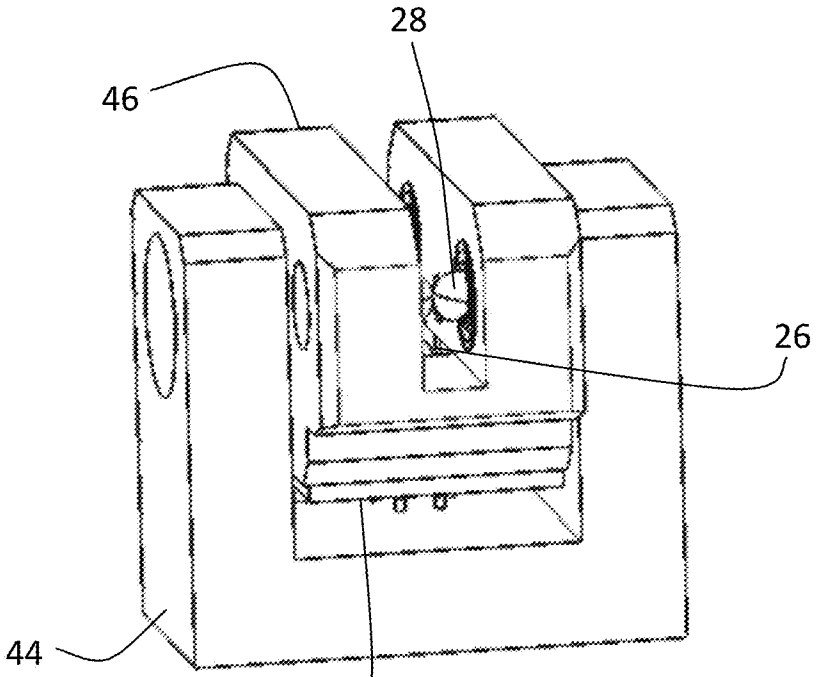
FIG. 9 is a perspective view of the sharpness testing system.
Figure 12:
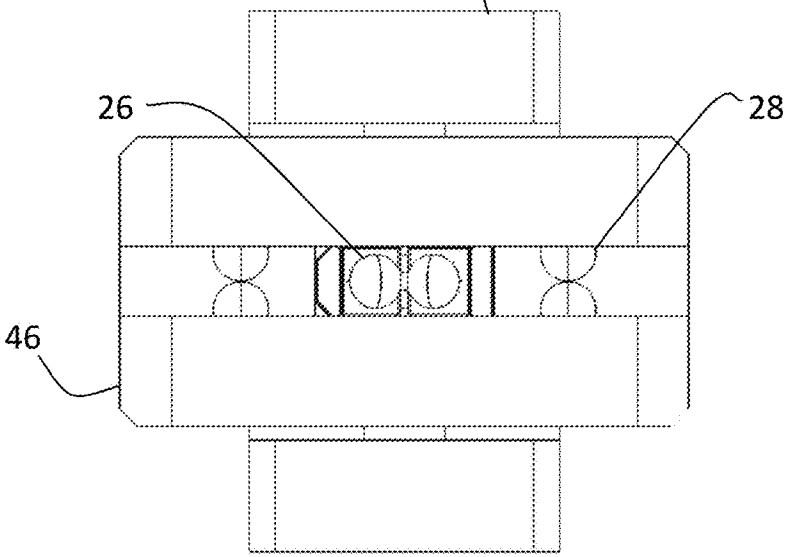
FIG. 12 is a top plan view of the sharpness testing system.
Figure 11:
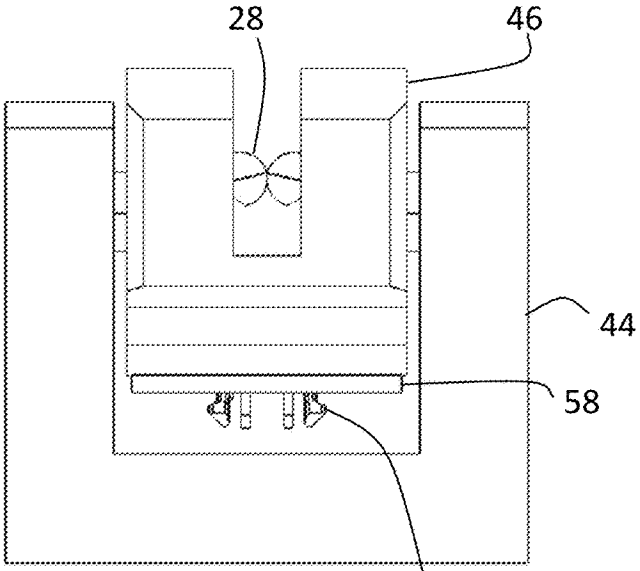
FIG. 11 is view in front elevation of the sharpness testing system.

The blade sharpening mechanism can be understood with additional reference to FIGS. 5 and 6 where the sharpening and sharpness detection system 10 is shown without the housing cover 12. There, the system 10 can be seen to have a framework 25 that is structured to include a bottom 36 that retains a sharpening wheel support structure 42, a detection system support structure 54, and a battery case support structure 56. The sharpening wheel support structure 42 is divided in this embodiment into three wheel supports, each with first and second upstanding arms, comprising a proximal support adjacent to the optical inspection unit 26, a central support, and a distal support adjacent to an end of the support structure 42. A coarse sharpening wheel 30 is rotatably retained by the proximal support, a fine sharpening wheel 32 is rotatably retained by the central support, and a polishing wheel 34 is rotatably retained by the distal support.

Figure 18:
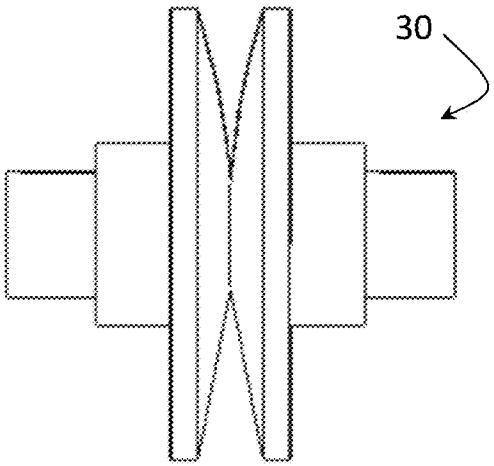
FIG. 18 is a view in front elevation of the sharpening wheel for the system for blade sharpening and contactless blade sharpness detection.
Figure 17:
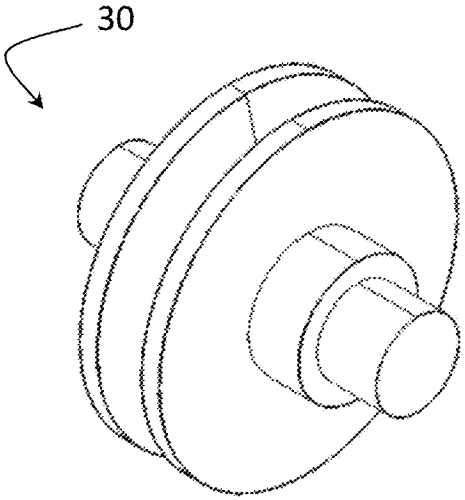
FIG. 17 is a perspective view of a sharpening wheel for the system for blade sharpening and contactless blade sharpness detection.

The coarse sharpening wheel 30, which is typical of the fine sharpening wheel 32 and the polishing wheel 34 except for the blade finishing characteristics required for coarse sharpening, fine sharpening, or polishing, respectively, is shown apart in FIGS. 17 and 18. There, the sharpening wheel 32 can be seen to have a pivot axle that supports first and second conical discs in opposition such that a torroidal, V-shaped sharpening channel is disposed therebetween.

The supports of the sharpening wheel support structure 42 are disposed to retain the coarse grinding wheel 30, the fine grinding wheel 32, and the polishing wheel 34 at non-zero, acute angles in relation to a longitudinal of the housing 12 while the housing 12 has corresponding slots 18, 20, and 22 that communicate laterally across the housing 12. More particularly, a coarse grinding slot 18 traverses laterally across the housing 12 overlying the angled coarse grinding wheel 30, a fine grinding slot 20 traverses laterally across the housing 12 overlying the angled fine grinding wheel 32, and a polishing slot 22 traverses laterally across the housing 12 overlying the angled polishing wheel 34.

The optical inspection unit 26 and the blade positioning and guidance mechanism 28 are retained by the detection system support structure 54 of the framework 25 and can be further understood with additional reference to FIGS. 8 through 16. As shown, the optical inspection unit 26 and the blade positioning and guidance mechanism 28 are mounted to a pivotable support block 46 that is retained by an aperture 64 in the pivotable support block 46 to pivot about a pivot axis 60 in relation to a fixed support cradle 44. The support cradle 44 is, in turn, fixed to the detection system support structure 54 and the framework 25. The pivotable support block 46 has a base portion and first and second opposed walls separated by a guidance and sensing channel.

Figure 14:
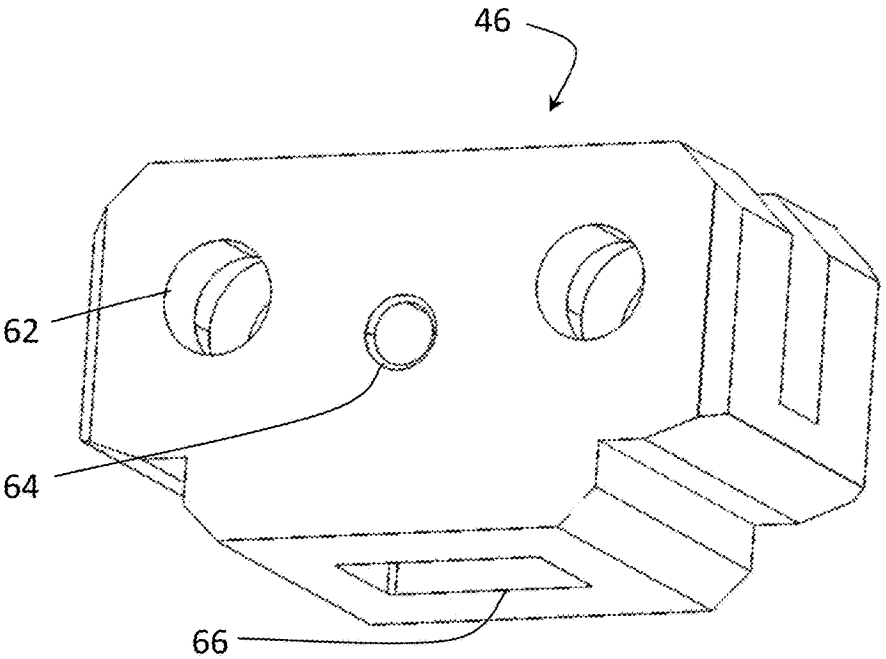
FIG. 14 is a lower perspective view of the pivoting blade cradle of the sharpness testing system.
Figure 13:
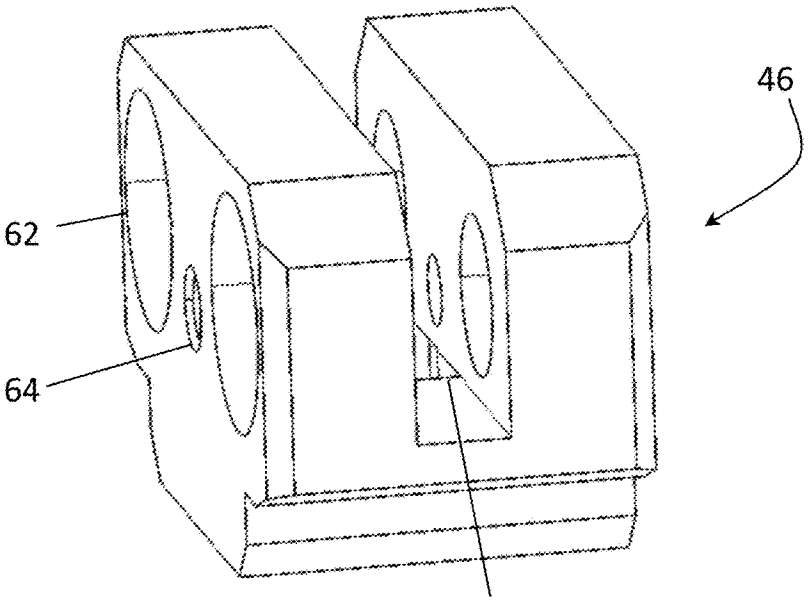
FIG. 13 is an upper perspective view of the pivoting blade cradle of the sharpness testing system.
Figure 15:
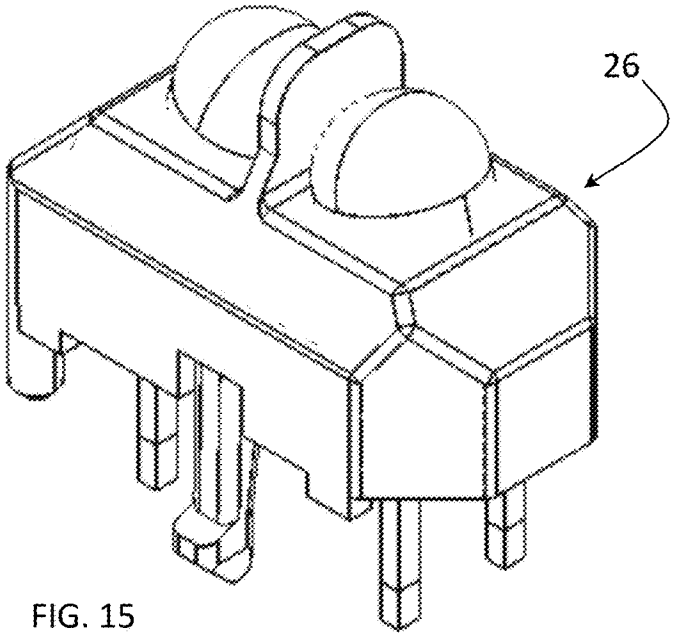
FIG. 15 is an upper perspective view of an infrared reflective sensor of the sharpness testing system.
Figure 16:
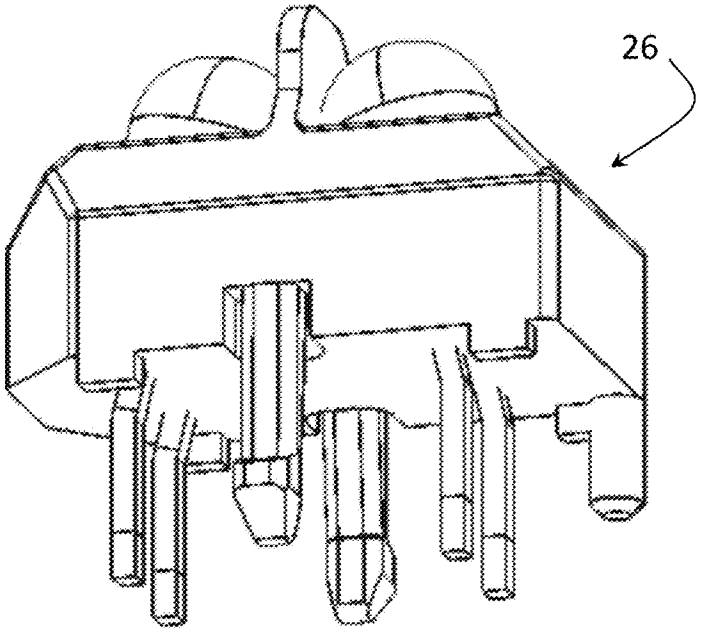
FIG. 16 is a lower perspective view of an infrared reflective sensor of the sharpness testing system.

The optical inspection unit 26 is retained by the pivotable support block 46 to pivot therewith. More particularly, in the present embodiment as shown in FIG. 14, for example, the pivotable support block 46 has a base aperture 66 in the base portion thereof that is open to the guidance and sensing channel. The optical inspection unit 26 is fixed within the base aperture 66 to be in optical communication with the guidance and sensing channel, and a printed circuit board 58 with an electronic processor is fixed to the optical inspection unit 26.

In one embodiment, the optical inspection unit 26 comprises a reflective optical sensor with an optical pair comprising a light emitter and a photodetector to provide an evaluation of the sharpness of a localized portion of a blade 100. While in the embodiment depicted in, for instance, FIGS. 15 and 16, the emitter and the photodetector are retained as a unified structure, the components could readily be disposed separately within the scope of the claims except as they may be expressly limited. Within the scope of the invention but again without limitation, for instance, a separate light emitter and a single-element photo detector or an image sensing camera could be employed instead of an optical pair for operation with the circuit board 58. A band-pass optical filter that is matched with the wavelength of light emitted by the light emitter may be placed in front of the single-element photo detector or camera to further reduce the influence of any wide-band ambient light passing through the blade accepting slot 14. Reference to an optical inspection unit 26 shall not be interpreted to require a unitary structure unless the claims particularly specify the same.

Sharpness can be estimated based on a measurement of light power that is acquired by a photo receiver of the optical inspection unit 26 with a single sensitive area, such as a photodiode photo transistor or other system for measuring light power to provide an integral estimation of sharpness. The optical response from the optical inspection unit 26 is directed to the electronic analog or digital processing circuit 58. The processing circuit 58 can include or be electronically connected to a computer processor, which can make a determination regarding blade sharpness based on light power reflected by the blade 100.

It is further contemplated that the optical inspection unit 26 can comprise an image-sensing camera with matched optics to collect video images of a cutting edge of a blade 100 that is supported and guided as disclosed herein and moved by a user. Acquired data regarding blade sharpness acquired by the camera can be derived from the camera image stream in combination with a computerized image processing program, and the acquired data can be retained in electronic memory. A detailed evaluation of sharpness over the continuous evaluated length of a blade 100 can be acquired, stored, and analyzed based on linear position along the blade 100. The detailed evaluation of sharpness can include facet angles, local cutting edge defects, and other details.

Figure 21:
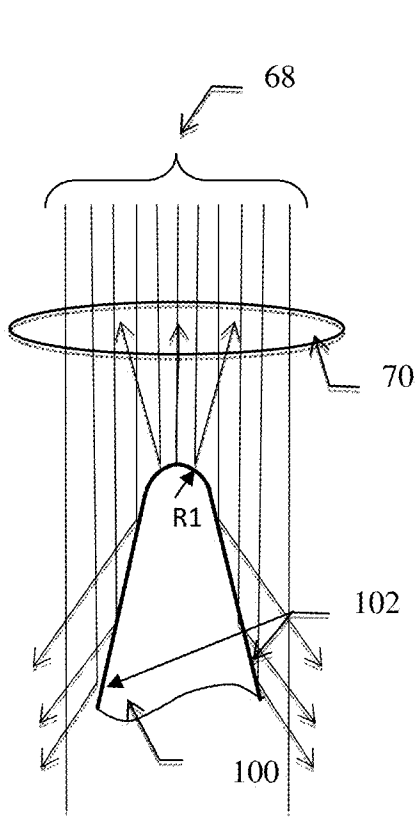
FIGS. 20 and 21 are schematic views depicting the sensing of varying levels of blade sharpness according to the present invention.
Figure 20:
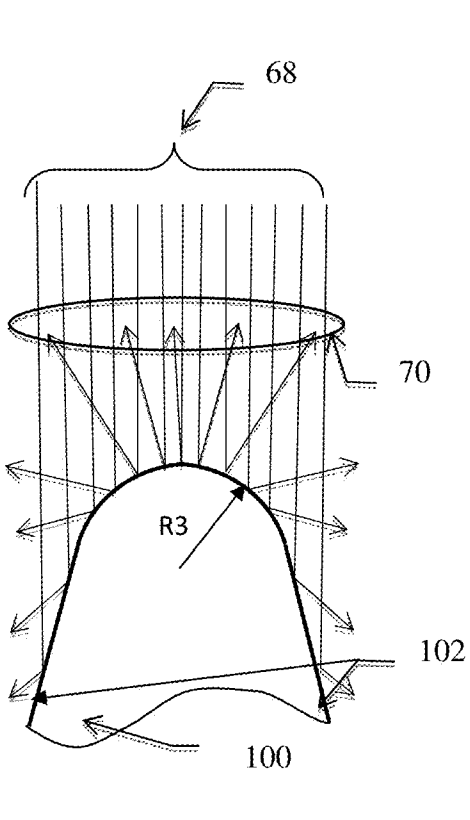
Figure 19:
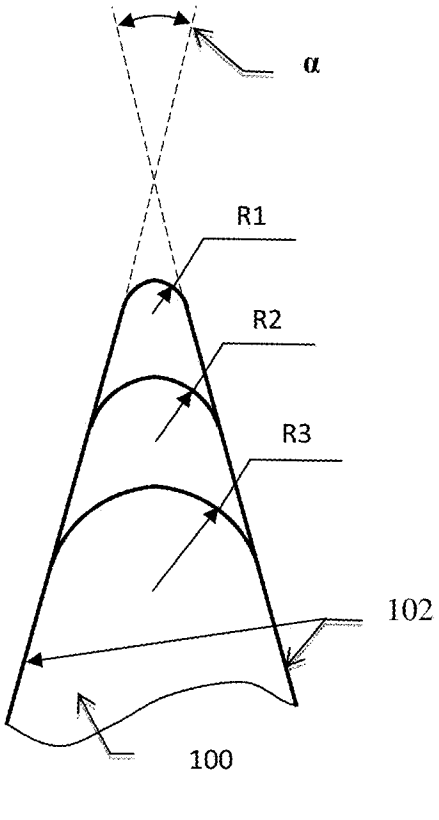
FIG. 19 is a schematic view depicting varying levels of blade sharpness.

To comprehend the operation of the optical inspection unit 26, the computer processing circuit 58, and the sharpening and sharpness detection system 10 in general, a further review of the characteristics of a cutting blade 100 and the optical interaction between the cutting blade 100 and the optical inspection unit 26 would be assistive. With reference to FIGS. 19, 20, and 21, a cutting edge of a blade 100 is formed by two facets 102 with a cutting edge angle $\alpha$ between them. These facets 102 in reality never actually intersect, which would create a cutting line with zero width. Instead, the facets 102 are joined by a transition surface, which can be represented as a half cylinder, with a certain averaged radius of curvature. In FIG. 19, three radii of curvature are shown with R1 comprising a sharp radius of curvature, R2 comprising an intermediate radius of curvature, and R3 representing the radius of curvature of a dull blade 100. This cylindrical surface is referred to as the cutting edge. The sharpness of the blade 100 is defined by the radius of the cutting edge. This radius can have a sub-micron value for very sharp blades 100.

When the cutting edge is illuminated by a collimated light bundle, such as that indicated at 68 in FIGS. 20 and 21 and which could be emitted by the optical inspection unit 26 or by another light source, a portion of the incoming beams of the light bundle 68 are reflected back from the cutting edge while the rest of light moves past the edge or is scattered. The back-reflected beams are acquired by the light acquiring aperture 70 of the optical sharpness sensor 26. The optical inspection unit 26, whether it be a camera with a lens, a photodiode, a phototransistor, or a reflective optical pair, such as but not limited to a photodiode and photo receiver combined into a single case as in the embodiment depicted in FIGS. 15 and 16, or another optical inspection unit 26 capable of optically acquiring data as to the sharpness of a given blade 100, for instance, may serve as an optical sharpness sensor 26.

The relative amount of light received by optical sharpness sensor 26 depends on the radius of the cutting edge and the surface roughness of the edges of the blade 100. As can be understood with reference to FIGS. 20 and 21, the smaller the radius of the cutting edge and the smoother the surfaces of the cutting edge and the facets 102, the less light intensity is reflected back to the photodetector 70 of the optical sharpness sensor 26. Conversely, the greater the radius of the cutting edge and the rougher the surfaces of the cutting edge and the facets 102, the greater the light intensity reflected back to the optical sharpness sensor 26. A small radius and smooth edges and thus a lower returned light intensity can be determined to be characteristic features of a sharp blade 100. The optical sharpness sensor 26 and the associated computer circuitry can thus exploit this effect to electronically convert, such as based on an algorithm, the reflected light intensity to a measurement of the sharpness of the blade 100 with the smaller the photoelectric response of the photodetector indicative of the sharper the blade 100.

As set forth above, the sharpening and sharpness detection system 10 could be induced into operation automatically, such as by the insertion of a blade 100, or it could be actuated by the pressing of a power button 24, which can be electrically associated with a printed circuit board 24 for the power button 24. The sharpening and sharpness detection system 10 could be powered by a battery pack 55 or, potentially, by alternating current from a source of electric power. As in FIG. 4, a battery pack cover 38 could be employed to provide selective access to the battery pack 55 for insertion, replacement, recharging, or otherwise. The bottom 36 of the sharpening and sharpness detection system 10 has a plurality of apertures 40 therein for allowing heat dissipation and for enabling the passage of particulate matter deriving from blade sharpening.

For the optical sharpness sensor 26 to operate reliably, the position of the blade 100 in relation to the sensor 26 must be established and maintained in a stable manner. In the depicted embodiments, the blade 100 is stably positioned and guided during movement in relation to the optical sharpness sensor 26 by the blade positioning and guidance mechanism 28. The positioning and guidance mechanism 28 accurately positions and guides the blade 100 in relation to the optical sharpness sensor 26 while permitting the avoidance of mechanical contact between the actual cutting edge of the blade 100 and the positioning and guidance mechanism 28 once the blade 100 is fully inserted into the positioning and guidance mechanism 28.

Referring to FIGS. 8 through 12, 22, and 23, the positioning and guidance mechanism 28 is founded on two pairs of rigid spheres. Within each pair of spheres, each sphere is pressed into contact with the other within the guidance and sensing channel between the opposed walls of the pivotable support block 46. The spheres of each pair thus have a single point of contact, and the surfaces of the spheres form a cylindrically symmetric wedge-like gap with arcuate walls. In embodiments of the invention, the spheres have diameters of approximately 3 to 4 millimeters. The pairs of spheres of the positioning and guidance mechanism 28 are disposed at matching positions in the guidance and sensing channel distally and laterally spaced with respect to the optical sharpness sensor 26 so that the optical sharpness sensor 26 is centered between and proximal to the pairs of spheres of the positioning and guidance mechanism 28.

Figure 22:
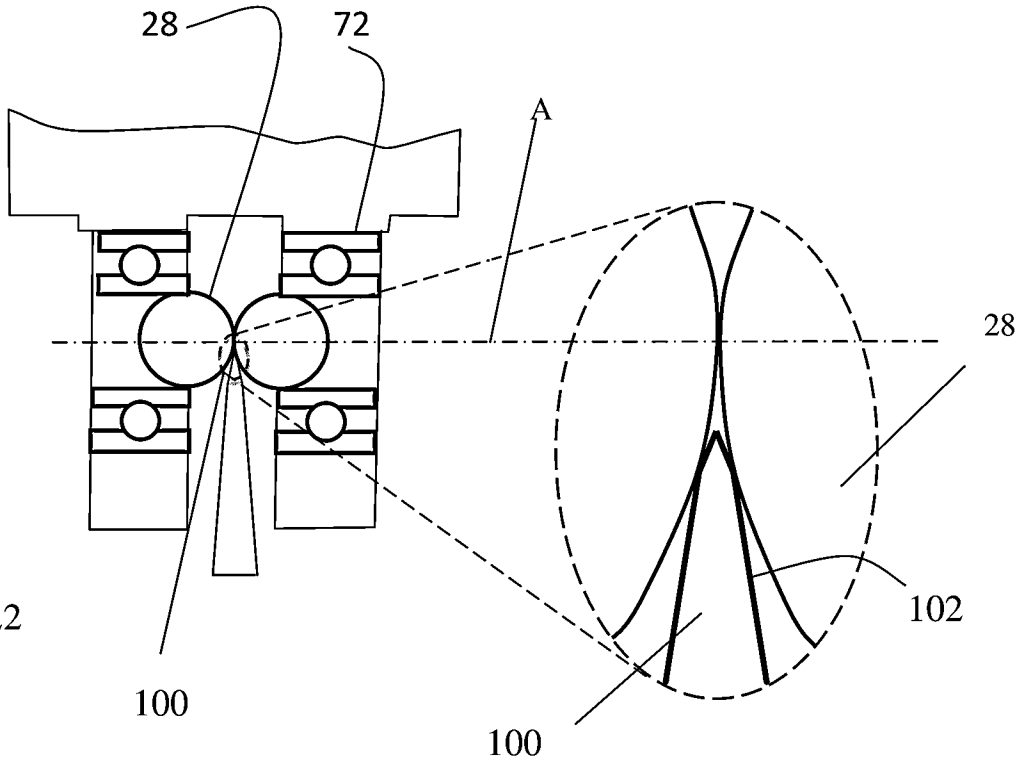
FIG. 22 is a view in front elevation of a blade during sharpness testing pursuant to the present invention.
Figure 23:
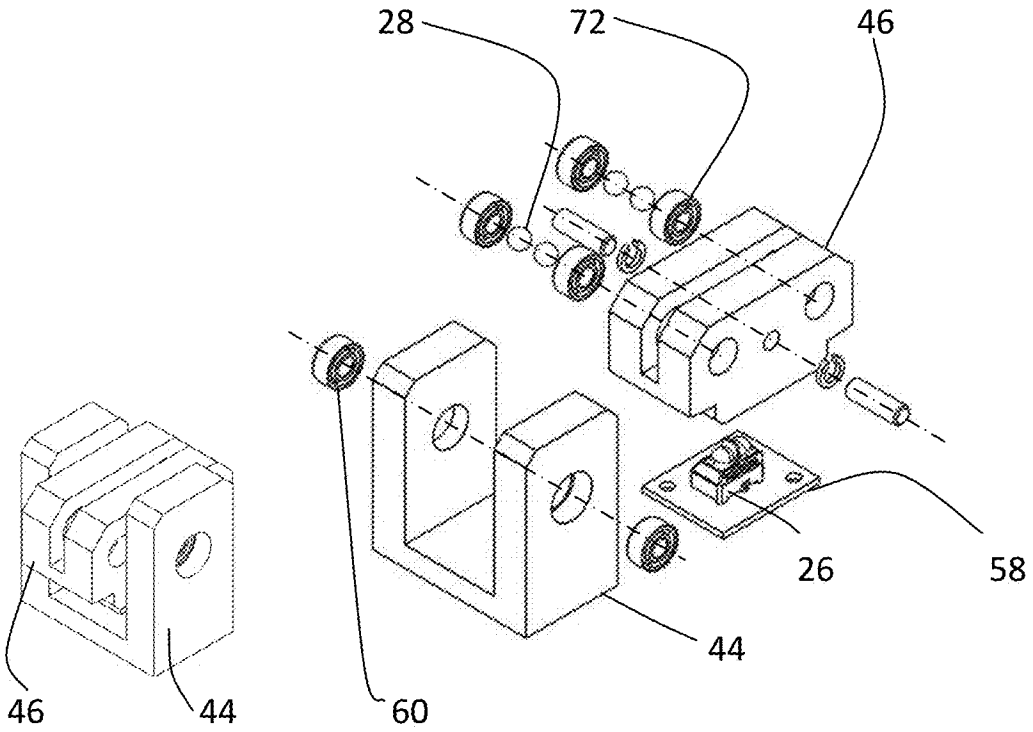
FIG. 23 is an exploded perspective view of a sharpness testing system as disclosed herein.

As shown in FIG. 22, the spheres are retained by rotary bearing assemblies 72 to be rotatable about a common axis A that is centered on the point of contact between the spheres. The axis A passes diametrically through the spheres, and the axes A of the pairs of spheres are parallel to one another and communicate laterally across the guidance and sensing channel. As is best seen in the amplified view of FIG. 22, the angle between the spherical surfaces is equal to zero at the point of contact between the spheres and then continuously grows with the distance from the point of contact.

Under this construction, a blade 100 can be inserted into the progressively narrowing spaces between the pairs of spheres of the positioning and guidance mechanism 28. As a result of the geometry of the spheres and with respect to any available cutting edge angle, the blade 100 will contact the spheres at two points along the facets 102 proximal to the actual cutting edge of the blade 100. The cutting edge of the blade 100 projects beyond the points of contact between the facets 102 and the spheres and does not touch the hard surfaces of the spheres once the blade 100 is fully inserted. With that, the sharpness of the blade 100 can be detected with the blade 100 being maintained at a known and consistent position with respect to the optical sharpness sensor 26. Because the points of mechanical contact of the blade facets 102 with the rigid spheres are very small, the pressure at these contact spots is relatively large, and there is possibility of additional hardening of the cutting edge due to elastic deformation and cold hardening of the blade material.

Not only do the spheres of the positioning and guidance mechanism 28 establish a known controlled position and orientation of the blade 100 in relation to the optical sharpness sensor 26, but they also permit movement of the blade 100 along a longitudinal of the blade 100. By virtue of their ability to rotate as facilitated by the rolling bearing assemblies 72, the spheres act as rolling supports to the blade 100 as it is repositioned longitudinally. Because the actual cutting edge is free of contact with the positioning and guidance mechanism 28 once the blade 100 is in position, damage to even a very sharp edge during the measurement process is prevented, including during relative movement between the blade 100 and the optical sharpness sensor 26.

Moreover, it is contemplated that embodiments of the sharpening and sharpness detection system 10 could carry out at least some sharpening of the blade 100 based on the contact between the blade at the points of contact of the blade and the rigid spheres. For instance, where the spheres have a high hardness, such as in the range of approximately 65-70 HRC, further blade sharpening may be realized, such as but not limited to by plastic deformation to induce cold-hardening of the cutting edge of the blade 100 by the hard and smooth surfaces of the spheres. In certain non-limiting embodiments, the material of the spheres could comprise $Al_2O_3$ ceramic, sapphire crystal, carbide ceramic, super hard cobalt alloys, or other hard alloys, ceramics, or crystals.

It will again be noted that the optical inspection unit 26 and the blade positioning and guidance mechanism 28 are mounted to the support block 46, which in turn is retained to pivot about a pivot axis 60 in relation to the fixed support cradle 44. As a result, over a given range of pivoting, the support block 46 can pivot to engage a blade 100 fully or to pivot with a blade 100 that may be tilted in relation to the sharpening and sharpness detection system 10, such as during longitudinal movement of the blade 100 in relation to the support block 46 and the optical inspection unit 26.

An output of the sharpness of the blade 100 as sensed by the optical inspection unit 26 can be provided by the output display 16 or any other data displaying or data recording or presenting system. For instance, the output display 16 can provide a visual output of the sharpness of the blade 100 as sensed by the optical inspection unit 26. Output could be provided as an indication of a sharpness of a local position of a blade 100. For instance, the output display 16 can indicate the sensed sharpness of the local portion of the blade then positioned to be inspected by the optical inspection unit 26.

Figure 25:
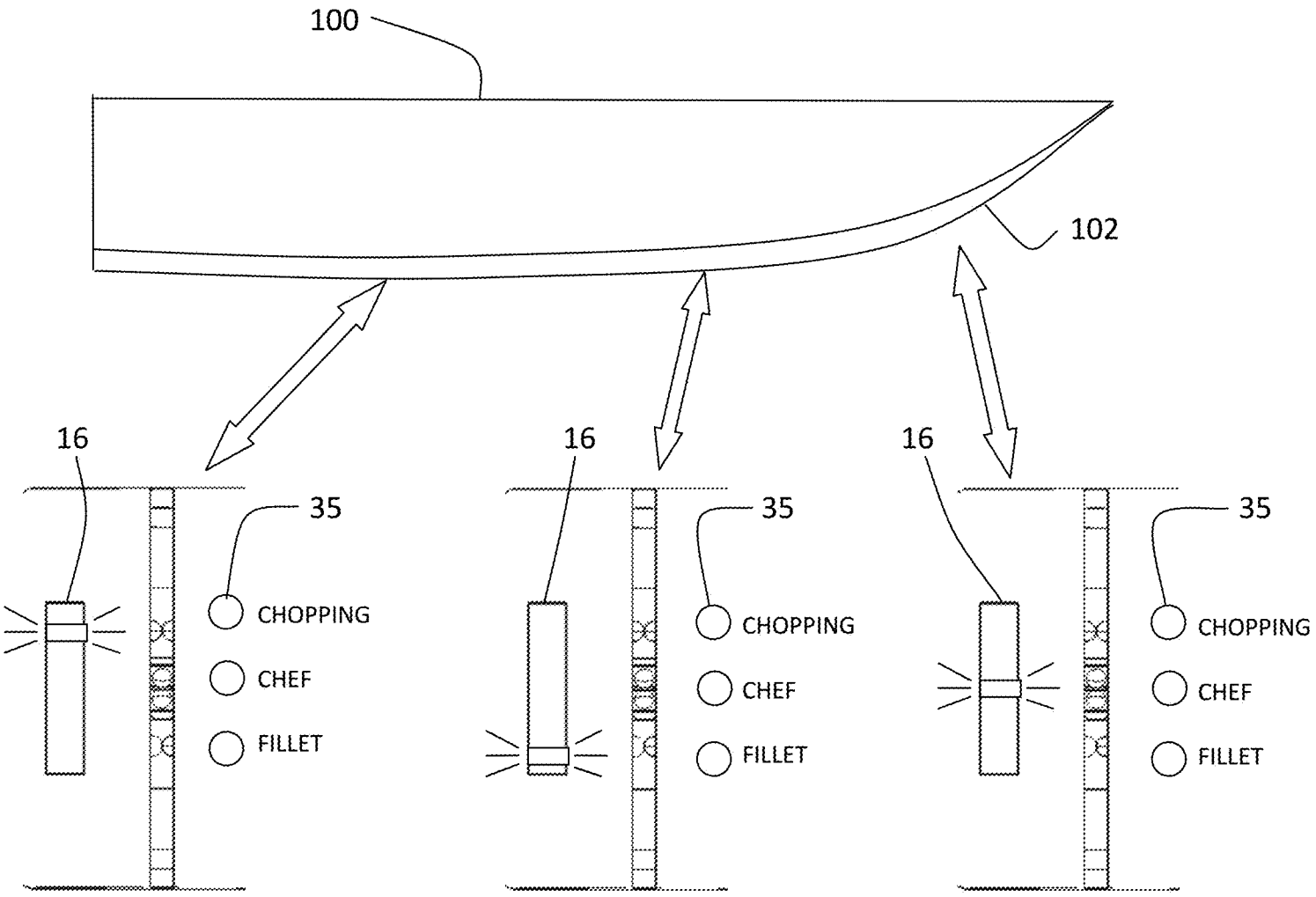
FIG. 25 is a schematic view depicting the sensing of varying levels of blade sharpness on a given blade according to the present invention.

By operation of the rolling support provided by the blade positioning and guidance mechanism 28, the blade 100 can be positioned and adjusted in position longitudinally in relation to the optical inspection unit 26 to provide specific indications to the user of the sharpness of each location along the blade 100. For instance, as shown in FIG. 25, the output display 16 for a series of positions along the blade 100 indicates that the facets 102 have a sharp cutting edge at a proximal portion of the blade 100, a dull cutting edge at a mid-portion of the blade 100, and a mid-level sharpness adjacent to the tip of the blade 100.

The optical inspection unit 26 and the output display 16 can also provide progressive indications of the sharpness of the blade 100 during stages of sharpening using the integrated blade sharpening mechanism formed in this example by the coarse sharpening wheel 30, the fine sharpening wheel 32, and the polishing wheel 34. For instance, as in FIG. 24A, a user could first verify that portions of the blade 100 are quite dull and require coarse sharpening. As in FIG. 24B, a further inspection of the same location on the same blade 100 can provide an indication that the blade 100 has reached a mid-level of sharpness such that further coarse sharpening is not required and the user can move on to fine sharpening. Finally, as in FIG. 24C, still further inspection of the blade 100 can produce an indication that the blade 100 has reached a specified level of sharpness such that the user can move to polishing or consider the sharpening process complete. Where, the sharpening mechanism and the optical inspection unit 26 are retained by a single housing as disclosed herein, the full operation of sharpening and testing can be accomplished with the unitary sharpening and sharpness detection system 10.

Additionally or alternatively, output could be provided, such as in a chart, wave, or other format or report, of sensed sharpness based on position along a blade 100. For example, where a blade 100 has been caused to translate longitudinally in relation to the optical inspection unit 26, electronic data regarding blade sharpness over the length of the blade 100 could be obtained and recorded in electronic memory, and a report charting that sharpness based on blade location can be output, such as by a computer display, by a visual display 16 on the housing, by a printed report, or by any other method. The user can thus be apprised of particular locations along the blade 100 that require specific attention and those locations that are already sufficiently prepared.

The type of output to indicate sensed blade sharpness could vary within the scope of the invention. The output could be a visually-perceptible output display 16 as shown, an audible output, or any other output. For instance, the output display 16 could be embodied as a qualitative visual display, such as a series of light-emitting diodes, an illuminated lightpipe, or any other qualitative visual display providing a visual indication dependent on the sensed sharpness of the blade 100. In the depicted example, the output display 16 comprises a lightpipe with a qualitative display wherein the higher the illuminated portion of the display the higher the sharpness of the blade 100. The output display 16 could additionally or alternatively be color coded, such as by having a red indication indicative of a dull blade with progressive changes in color coding until a green display indicative of ideal sharpness is achieved. Textual markings, gradations, or other indications adjacent to the output display 16 can provide indications of the meaning of the display. The output display 16 is electronically coupled with a printed circuit board 50, which is in turn supported by posts 48 that are supported by the bottom 36 of the system 10. Other output displays 16 could include, but not be limited to, numerical displays, dial gauges, or any other type of output display 16 capable of presenting or conveying the acquired sharpness data.

It is also contemplated that the sharpening and sharpness detection system 10 could be adjustable with respect to the blade sharpening angles, blade sharpness levels, or otherwise to accommodate different blade types and different user goals. For instance, the optical sharpness sensor 26 and the associated computer circuitry, the output display 16, and, additionally or alternatively, other components of the system 10 could be adjustable to provide different levels of optical signal characteristics to permit the user to select the type of blade 100 to be sharpened, such as a butcher knife as compared to a pairing knife as compared to a hunting knife, to receive a particularized level of accuracy in the output display 16 or other output based on the sharpness of the blade 100 in relation to the selected setting.

The blade sharpening and sharpness detection system 10 can also permit a user to input a known sharpness angle or other sharpening characteristic, and software operating in relation to the blade sharpening and sharpness detection system 10 can provide sharpening through the integrated blade sharpening mechanism and, additionally or alternatively, output, such as through the output display 16 or otherwise to provide an indication of the condition of the blade 100 in comparison to the predetermined input sharpening characteristic. For instance, a given indication, such as a color-coded, scale-oriented, or other indication, can be given when the blade 100 is not found by the optical sharpness sensor 26 and the computer software to meet the input sharpening characteristic, and a different indication can be given when the blade 100 is found to meet the input sharpening characteristic. A non-limiting example of such an embodiment is depicted in FIG. 25. There, a user can actuate an input button 35 to input a predetermined sharpening characteristic from among typical sharpening angles for a chopping knife, a chef's knife, or a fillet knife, and the optical sharpness sensor 26 and software operating on the system 10 can automatically detect and indicate the sharpness condition of the blade 100 in comparison to the selected sharpening characteristic. The sharpening characteristic input system further enables verification and calibration of proper operation of the optical sharpness sensor 26, such as upon initial manufacture of the system 10 or during maintenance.

It is recognized that, within the blade sharpening and sharpness detection system 10, there may be a change in optical signal between blades 100 of corresponding sharpness but with different cutting edge angles. The software algorithm operating on the system 10 is coded to correct for the foregoing. Moreover, the software algorithm is coded to accommodate any phenomenon where reflected light varies non-linearly in comparison to blade sharpness. The system 10 can thus readily provide an accurate sharpness progress indication with respect to blades 100 sharpened at, for instance, fifteen-degree angles and twenty-five degree angles even where the optical signal levels provided by those angles is different, and the system 10 can provide accurate indications of sharpness even where the reflected light returned to the optical sharpness sensor 26 does not vary linearly with changes in sharpness.

Using the blade sharpening and sharpness detection system 10, a user is thus enabled to sharpen a blade 100 by use of the integrated blade sharpening mechanism while also being able to test and be apprised of the current sharpness of the blade 100 by use of the optical sharpness sensor 26 and the output display 16. Furthermore, in certain embodiments, such as where a camera is used as all or a component of the optical sharpness sensor 26, video can be obtained and stored in electronic memory of blade sharpness dependent on linear position along the cutting edge of the blade 100. For example, a user can insert the blade 100 into position contacting both sets of spheres of the positioning and guidance mechanism 28 to ensure that proper positioning of the blade 100 is achieved. The sharpening and sharpness detection system 10 can be automatically triggered into operation or actuated as by a pressing of the power button 24 to cause a sensing of the localized sharpness of the blade 100. The blade 100 can be manually moved over the optical sharpness sensor 26 so that sharpness along the length of the blade 100 can be sensed and, as necessary, acted upon by the user through further blade processing using the integrated blade sharpening mechanism. In certain practices of the invention, the contactless optical sharpness sensor 26 can produce a video stream with multiple image frames of the illuminated cutting edge of the blade 100 to be measured. Additionally or alternatively, the system 10 can provide an analog optical response signal that is inversely proportional to the cutting edge sharpness of the illuminated portion of the blade 100. The analog signal can be amplified and processed with an analog circuit to produce a control signal for the display. The video stream can be sent to a processor for online or offline processing or stored for later processing. An image processing algorithm is used within one of the electronic processors of the invention to compute the parameters of edge sharpness, such as the cutting angle of the blade 100, edge sharpness, blade defects, and the roughness of the cutting facets 102. The analog signal can be compared with predetermined data to provide a comparative and, additionally or alternatively, a qualitative estimate of blade sharpness. The data about the cutting edge sharpness can be sent to an output display or for storage or processing. Based on the results and the output of the sharpness testing, a user can continue a given stage of sharpening or move to a finer sharpening stage or consider the sharpening process to be complete.

As discussed above, having devised of a system for sharpening a blade and for testing blade sharpness in a single apparatus, the present inventors recognized that ambient light entering and reflecting within a sharpness testing apparatus has deleterious effects of the ability to measure sharpness optically. This is particularly true when the cutting edge of the blade 100 is very sharp whereupon the light returned to the optical inspection unit 26 becomes increasingly weak. It has been found that ambient light entering the inner volume of the system 10, such as through the slot 14 provided to receive the blade for sharpness inspection, and light scattered and reflected within the inner volume of the system 10 tend to distort the results of the sharpness measurement.

To solve these problems, the inventors have devised of constructions to prevent ambient light from entering what may be referred to as a sharpness sensing volume 75 into which a blade is to be received for sharpness testing. In certain embodiments as depicted herein, the sharpness sensing volume 75 may be considered to be bounded at least partially by the opposed walls and bottom of the pivotable support block 46. The sharpness sensing volume 75 in depicted embodiments envelops the optical inspection unit 26 and the blade positioning and guidance mechanism 28.

One embodiment of the blade sharpening and sharpness detection system 10 incorporating light-blocking technology can be understood with reference to FIGS. 26 through 31. With reference first to FIGS. 26 through 30, one can perceive that first and second light-blocking bodies 74 and 76 are retained to cooperate in shielding the sharpness sensing volume 75 against the entrance of ambient light 200 as is particularly illustrated in FIG. 30. The light-blocking bodies 74 and 76 in the present embodiment are mirror images of one another and are disposed in opposition.

Figure 27:
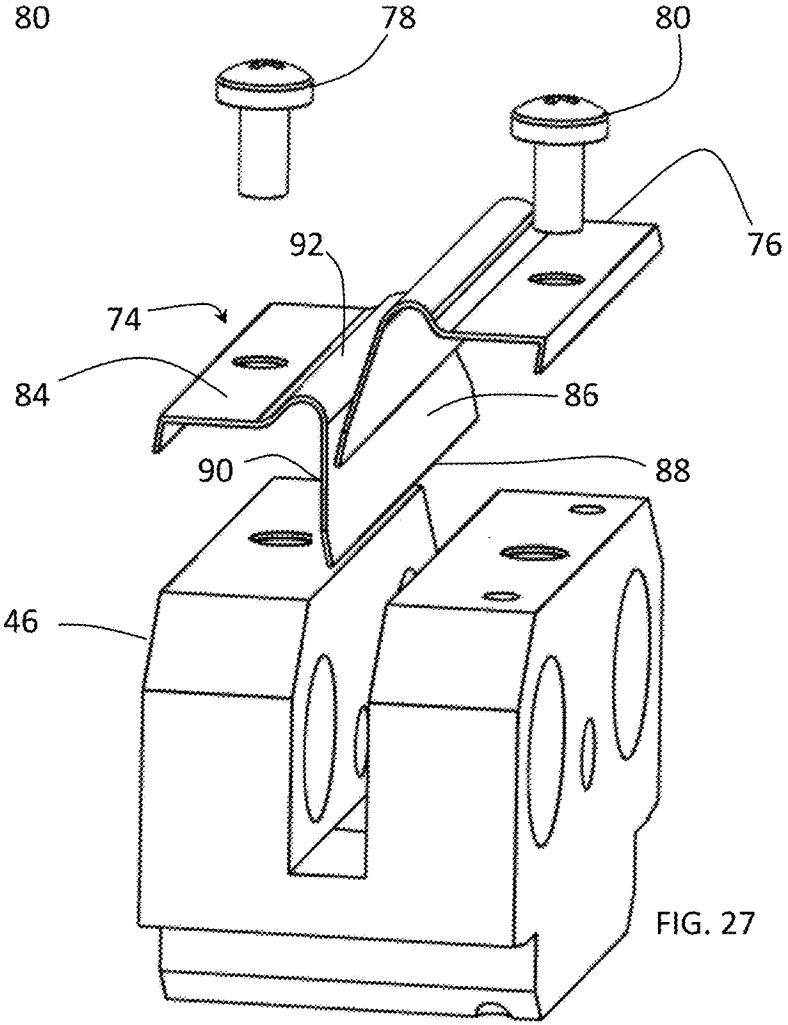
FIG. 27 is an exploded perspective view of the pivoting blade cradle of FIG. 26.
Figure 26:
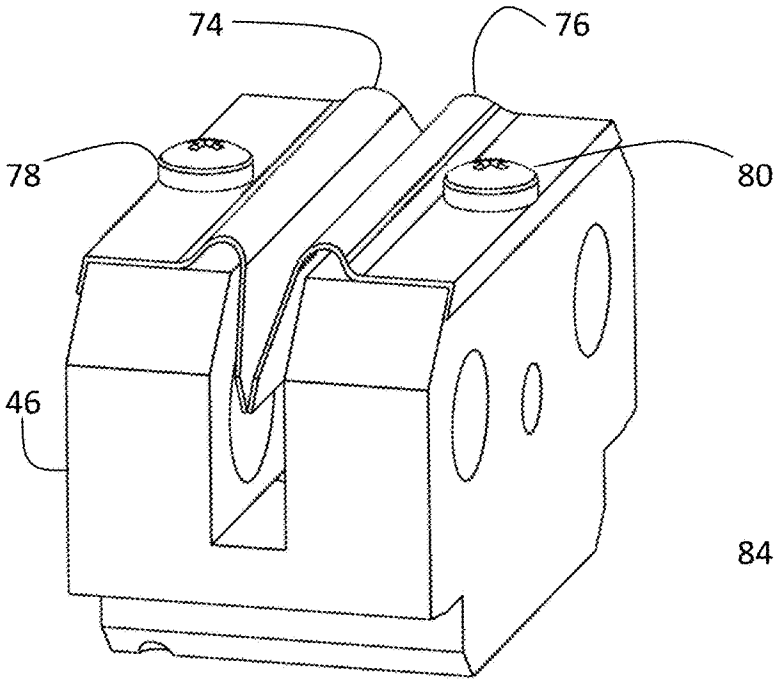
FIG. 26 is a perspective view of a pivoting blade cradle of an embodiment of the sharpness testing system incorporating light blocking bodies for preventing ambient light from entering the sharpness sensing cavity.
Figure 29:
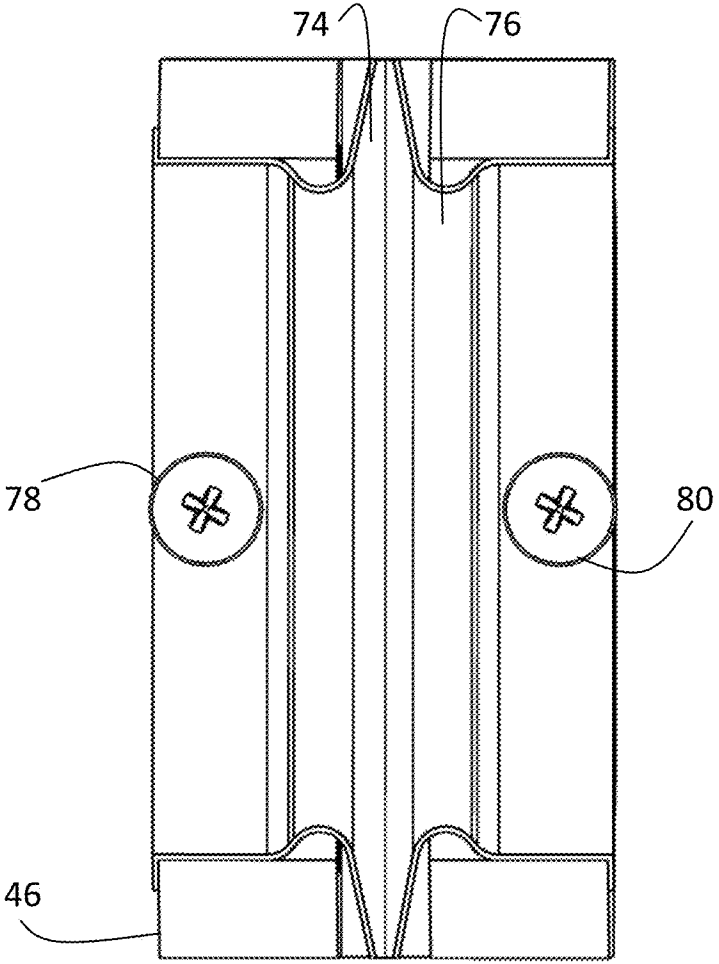
FIG. 29 is a top plan view of the pivoting blade cradle of FIG. 26.
Figure 28:
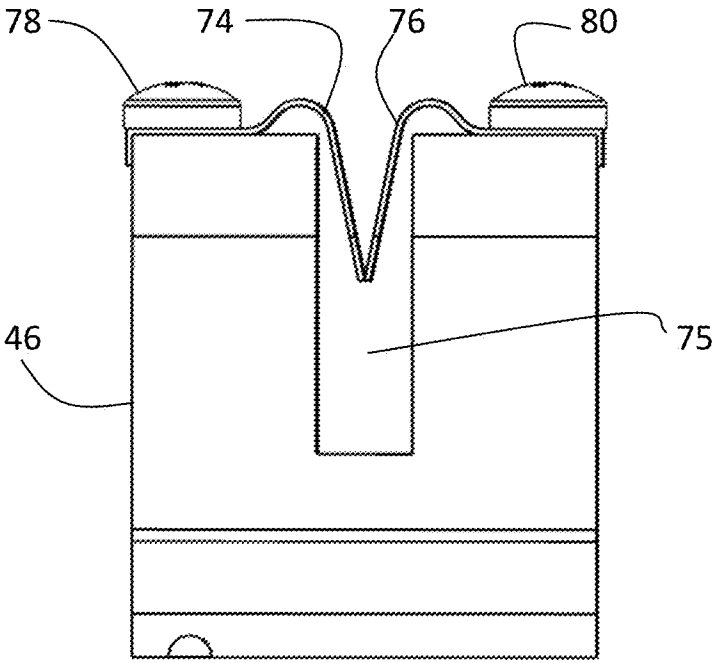
FIG. 28 is a front elevation view of the pivoting blade cradle of FIG. 26.

As shown in FIG. 27 with reference to the first light-blocking body 74, each light-blocking body 74 and 76 has a base portion 84. The base portion 84 of the first light-blocking body 74 overlies and is fastened to the upper edge of the first opposed wall of the pivotable support block 46, and the base portion 84 of the second light-blocking body 76 overlies and is fastened to the upper edge of the second opposed wall of the pivotable support block 46. As such, the light-blocking bodies 74 and 76 will pivot with the pivotable support block 46 within the housing 12. In the depicted embodiment, the light-blocking bodies 74 and 76 are secured to the pivotable support block 46 by mechanical fasteners 78 and 80 comprising screws. However, it will be understood that numerous other fastening methods are possible and within the scope of the invention.

Each light-blocking body 74 and 76 has a light-blocking wing portion 86 that extends at a non-zero angle toward a centerline of the guidance and sensing channel between the opposed walls of the pivotable support block 46. More particularly, the wing portions 86 of the light-blocking bodies 74 and 76 are inclined to extend at an oblique angle toward the center and bottom of the guidance and sensing channel until the distal blade-engaging edges 88 of the wing portions 86 are disposed in contact or immediate proximity with one another when the bodies 74 and 76 are in a non-deflected condition as, for instance, in FIGS. 26, 28, and 29. The wing portions 86 of the light-blocking bodies 74 and 76 meet along a centerline of the sharpness inspection slot 14 in a V-shape ready to receive and laterally engage a blade 100 as, for instance, in FIG. 30. The blade-engaging edges 88 of the wing portions 86 correspond in shape, in this example by being straight, such that, when the edges 88 meet against one another or against a blade 100 as in FIG. 30, they effectively seal ambient light 200 from passing them to enter the sharpness sensing volume 75.

Moreover, the light-blocking bodies 74 and 76 have first and second ends that are shaped and positioned to correspond to the overlying or adjacent shape of the housing 12 such that the passage of ambient light therebetween from the environment and into the sharpness sensing volume 75 is further prevented. In the depicted, non-limiting example, the housing has an arcuate upper cross-sectional shape, and the first and second ends of the light-blocking bodies 74 and 76 have shapes generally corresponding thereto, such as by themselves being disposed at oblique angles or in curved shapes that match or substantially match the localized shape and size of the housing 12. More particularly, as perhaps best appreciated with reference to FIGS. 26 and 27 in combination with FIG. 31, the depicted light-blocking bodies 74 and 76 have first and second ends that are generally outwardly sloped from the upper to lower portions thereof and are contoured in shape generally to match the localized shape of the housing 12.

The wing portions 86 are resiliently deflectable in relation to the base portions 84 and thus in relation to one another and in relation to the pivotable support block 46 and the guidance and sensing channel. To facilitate that resilient deflection, each light-blocking body 74 and 76 has a flex formation 92, here comprising an arcuate span, interposed between the base portion 84 and the wing portion 86. Moreover, each light-blocking body 74 and 76 is formed from a resiliently-deflectable material, such as but not limited to spring steel, bronze, a plastic, or some other resiliently deflectable material or combination thereof.

Figure 30:
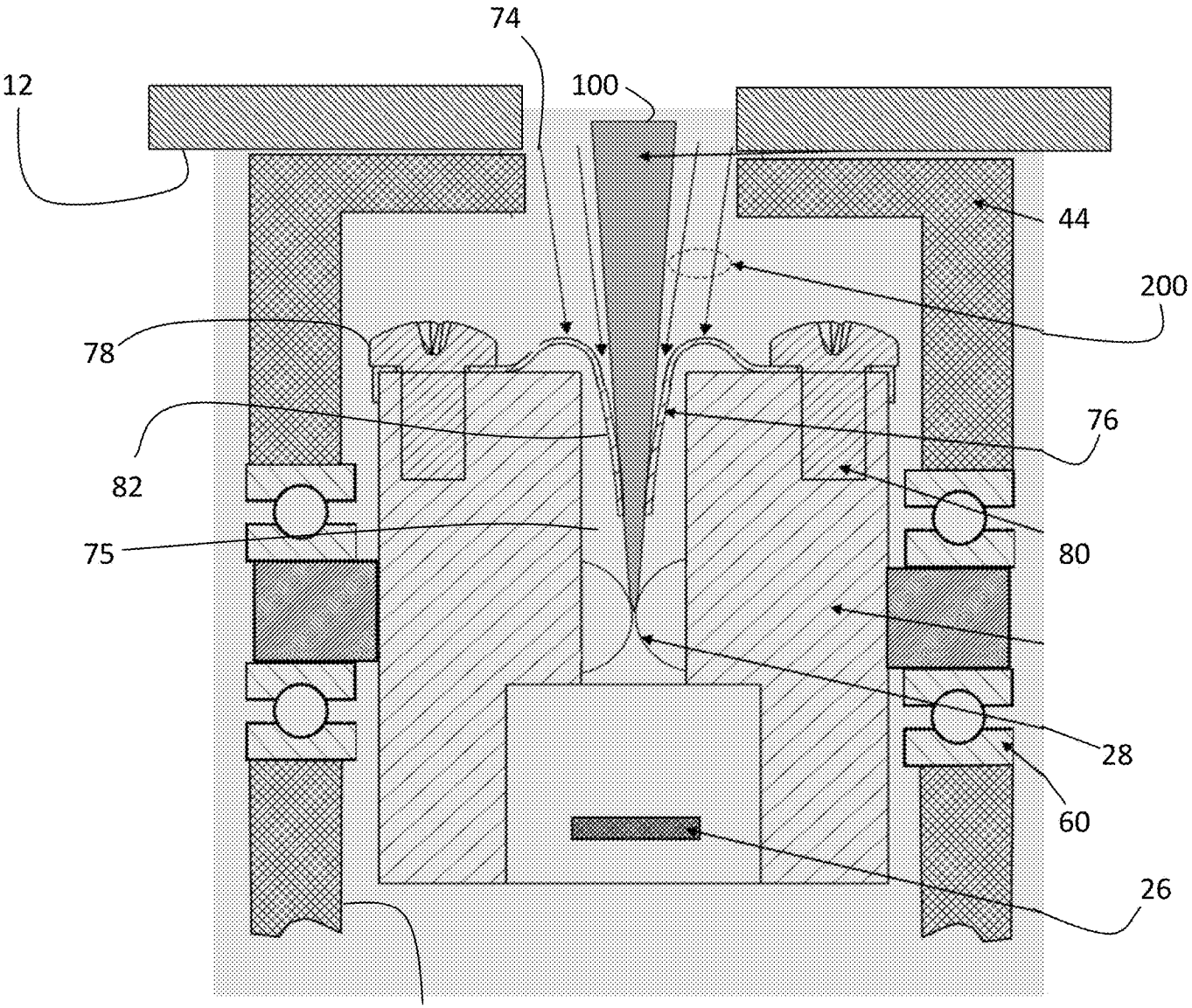
FIG. 30 is a sectioned view of a blade sharpness sensing apparatus incorporating light blocking bodies with a blade received therebetween.
Figure 31:
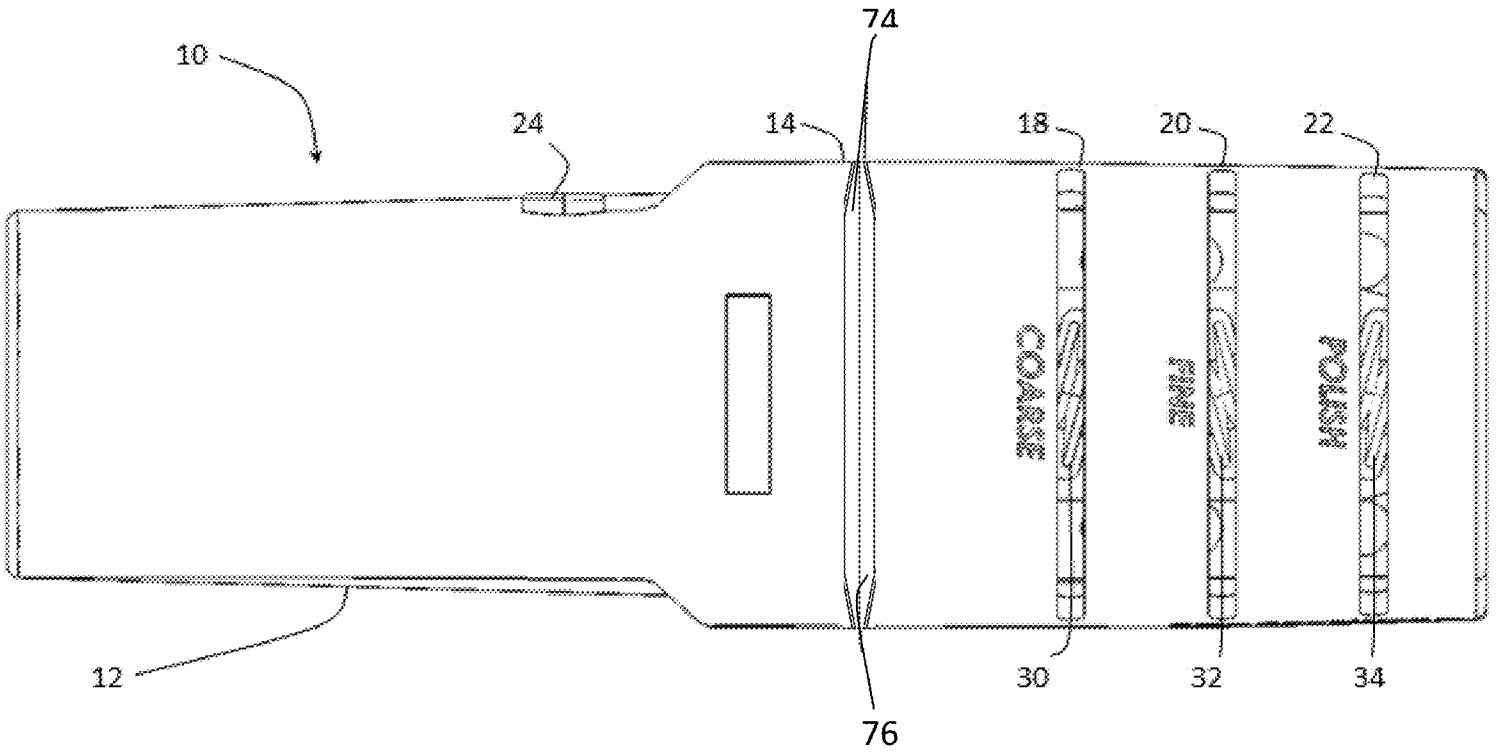
FIG. 31 is a top plan view of a system for blade sharpening and contactless blade sharpness detection incorporating light blocking bodies according to the present invention.

Under such constructions and with particular reference to FIGS. 30 and 31, when the blade sharpening and sharpness detection system 10 is fully assembled, the light-blocking bodies 74 and 76 will cooperate to block ambient light from entering the sharpness sensing volume 75 from external to the system 10. A blade 100 whose sharpness is to be inspected can be inserted into the sharpness inspection slot 14 to cause the edge of the blade 100 to deflect and pass between the light-blocking bodies 74 and 76 until reaching the spheres of the blade positioning and guidance mechanism 28. The blade-engaging edges 88 and the resiliently deflectable wing portions 86 are maintained in close contact with the sides of the blade 100 by the resiliency of the bodies 74 and 76 such that the passage of light therebetween is prevented. Moreover, with the conformance of the ends of the light-blocking bodies 74 and 76 to the housing 12 in shape and size, light is further prevented from entering the sharpness sensing volume 75. The bodies 74 and 76 make tight contact with the side faces of the blade 100 but do not impede longitudinal movement of the blade 100 during sharpness sensing. Furthermore, when the blade 100 is removed, the resilient bodies 74 and 76 return into mutual engagement thereby preventing dust and debris from entering the sharpness sensing volume 75 during periods of nonuse.

It is further contemplated and within the scope of the invention to limit the scattering and reflectance of any light that does enter the sharpness sensing volume 75 within the blade sharpening and sharpness detection system 10. To that end, surfaces within the pivotable support block 46, such as the inner surfaces of the opposed walls and bottom of the support block 46, of the light-blocking bodies 74 and 76, and other surfaces within the sharpness sensing volume 75 may be coated or treated to absorb light. By way of example and not limitation, a light-absorbing paint or other coating 82 may be applied to some or all surfaces within the sharpness sensing volume 75. With that, the impact of any light that might enter the sharpness sensing volume 75 despite the light-blocking bodies 74 and 76 will be minimized.

Figure 32:
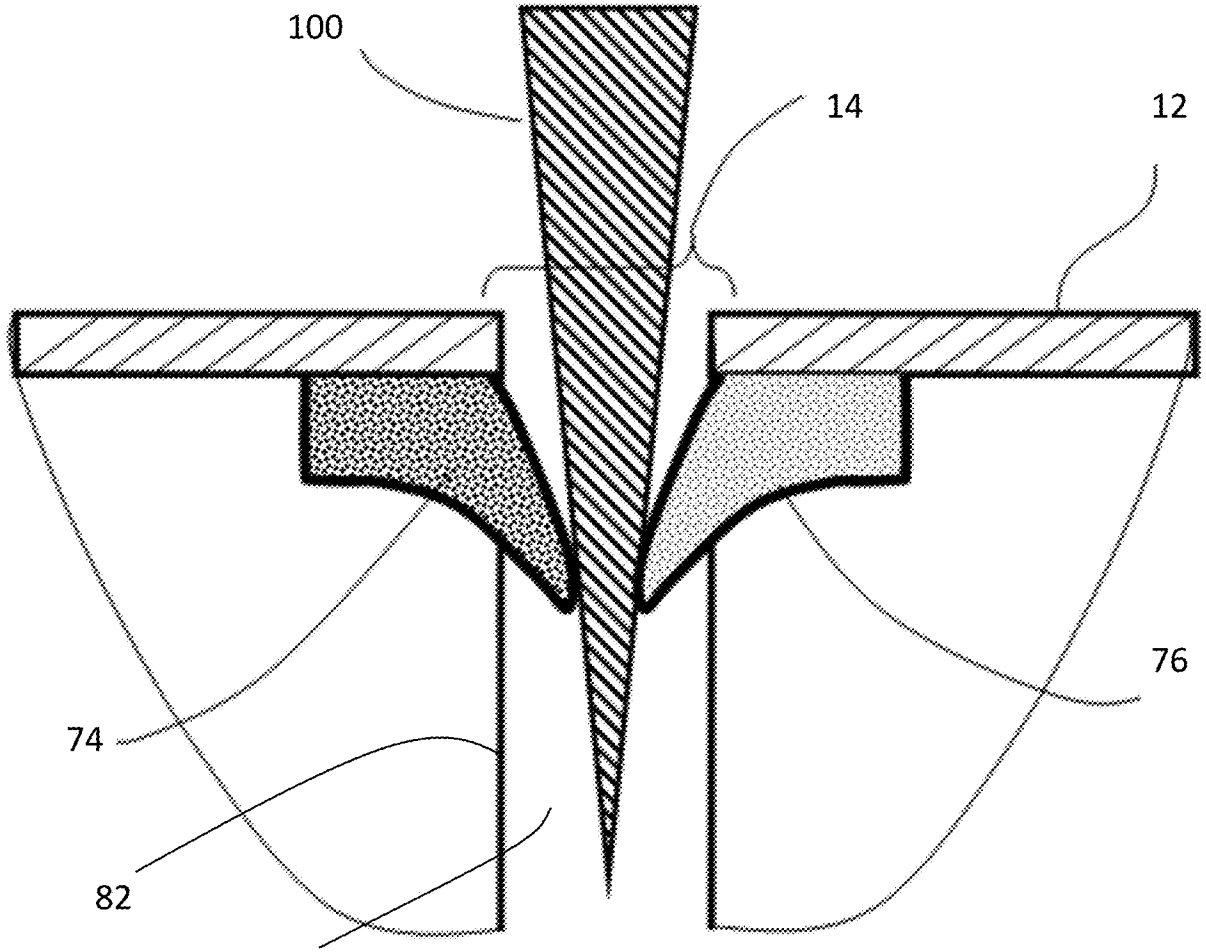
FIG. 32 is a cross-sectional view of alternative light blocking bodies retained for preventing ambient light from entering the sharpness sensing cavity.

It will be understood that the light-blocking bodies 74 and 76 could be otherwise formed and retained to prevent ambient light from entering the sharpness sensing volume 75 through the sharpness inspection slot 14. One alternative embodiment is illustrated in FIG. 32. There, first and second light-blocking bodies 74 and 76 are again provided. Here, however, the bodies 74 and 76 are fixed directly to the interior surface of the housing 12 to traverse along the entirety of the sides of the slot 14. The bodies 74 and 76 again have wing portions that communicate at oblique angles downwardly and toward the centerline of the slot 14 to meet in a V-shape thereby shielding against the entry of ambient light into the sharpness sensing volume 75. The bodies 74 and 76 are resiliently deflectable such that a blade 100 can be inserted into the slot 14 to cause the bodies 74 and 76 to deflect outwardly while effectively sealing against the sides of the blade 100. The bodies 74 and 76 in this embodiment could be formed from any material capable of blocking ambient light from entering the sharpness sensing volume 75. In certain embodiments, for instance, the light-blocking bodies 74 and 76 can be formed from a resiliently compressible and deflectable foam material, a brush material, or any other effective material. Again, by virtue of their resilient flexibility, the light-blocking bodies 74 and 76 protect against light and debris infiltration while not impeding the longitudinal movement of the blade 100 for sharpness inspection.

Again with the embodiment of FIG. 32, the surfaces within the sharpness sensing volume 75 may be coated or treated to absorb light. For instance, a light-absorbing paint or other coating 82 may be applied to surfaces within the sharpness sensing volume 75. With such a coating or treatment, any light that might enter the sharpness sensing volume 75 despite the light-blocking bodies 74 and 76 will be minimized in effect.

With certain details and embodiments of the present invention for systems for blade sharpening and contactless blade sharpness detection disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments. The invention shall not be limited with respect to any dimensions, relative size relationships, notations, or particular configurations shown or described herein except as expressly required by the claims.

Therefore, the following claims are intended to define the scope of protection to be afforded to the inventors. Those claims shall be deemed to include equivalent constructions insofar as they do not depart from the spirit and scope of the invention. It must be further noted that one or more of the following claims could express certain elements as means for performing a specific function, at times without the recital of structure or material. As the law demands, any such claims shall be construed to cover not only the corresponding structure and material expressly described in this specification but also all equivalents thereof that might be now known or hereafter discovered.

We claim as deserving the protection of Letters Patent:

1. A blade sharpness detection system for determining a sharpness of a blade, the blade sharpness detection system comprising:

an optical inspection unit operative to inspect blade sharpness optically; and a blade positioning and guidance mechanism disposed to position and guide the blade in relation to the optical inspection unit;

a housing, wherein the optical inspection unit and the blade positioning and guidance mechanism are retained within a sharpness sensing volume within the housing;

a sharpness inspection slot in the housing in alignment with the optical inspection unit and the blade positioning and guidance mechanism;

first and second light-blocking bodies retained in opposition within the housing by the blade sharpness detection system to prevent passage of ambient light through the sharpness inspection slot and into the sharpness sensing volume, wherein the first and second light-blocking bodies are adapted to receive the blade therebetween;

a pivotable support structure within the housing, wherein the optical inspection unit and the blade positioning and guidance mechanism are retained by the pivotable support structure, wherein the pivotable support structure is pivotable about a pivot axis within the housing, and wherein the first and second light-blocking bodies are fixed to the pivotable support structure whereby the first and second light-blocking bodies pivot with the pivotable support structure within the housing wherein the first light-blocking body is coupled or mounted to the pivotable support structure to a first side of a centerline of the sharpness inspection slot, and wherein the second light-blocking body is coupled or mounted to the pivotable support structure to a second side of the centerline of the sharpness inspection slot;

whereby the blade can be positioned in relation to the optical inspection unit by use of the blade positioning and guidance mechanism, whereby the sharpness of the blade in a position localized to the optical inspection unit can be inspected by the optical inspection unit, and whereby effects of ambient light on sharpness inspection are prevented.

2. The blade sharpness detection system of claim 1, wherein each light-blocking body comprises a resiliently deflectable light-blocking wing portion that extends toward a centerline of the sharpness inspection slot.

3. The blade sharpness detection system of claim 2, wherein the light-blocking wing portions of the light-blocking bodies are disposed to form a V-shape for receiving the blade therebetween.

4. The blade sharpness detection system of claim 3, wherein each light-blocking body further comprises a base portion fixedly retained by the blade sharpness detection system and a flex formation interposed between the base portion and the light-blocking wing portion.

5. The blade sharpness detection system of claim 2, wherein the light-blocking wing portions of the light-blocking bodies terminate in distal blade-engaging edges and wherein the blade-engaging edges correspond in shape.

6. The blade sharpness detection system of claim 5, wherein the blade-engaging edges of the light-blocking wing portions of the light-blocking bodies have portions that are straight.

7. The blade sharpness detection system of claim 6, wherein the blade-engaging edges of the light-blocking wing portions of the light-blocking bodies meet at the centerline of the sharpness inspection slot.

8. The blade sharpness detection system of claim 1, wherein the pivotable support structure has first and second opposed walls separated by a guidance and sensing channel, wherein the optical inspection unit is in optical communication with the guidance and sensing channel, wherein the blade positioning and guidance mechanism is disposed within the guidance and sensing channel spaced from the optical inspection unit, and wherein the sharpness sensing volume envelops the optical inspection unit and the blade positioning and guidance mechanism.

9. The blade sharpness detection system of claim 1, wherein the housing has an interior shape proximal to the first and second light-blocking bodies and wherein the first and second light-blocking bodies have first and second ends that are shaped and positioned to correspond to the interior shape of the housing proximal to the first and second light-blocking bodies.

10. The blade sharpness detection system of claim 9, wherein the housing has an arcuate upper cross-sectional shape and wherein the first and second ends of the light-blocking bodies have shapes corresponding thereto.

11. The blade sharpness detection system of claim 10, wherein the first and second ends of the light-blocking bodies are outwardly sloped and are contoured in shape in correspondence with the cross-sectional shape of the housing.

12. The blade sharpness detection system of claim 1, wherein the first and second light-blocking bodies are resiliently deflectable.

13. The blade sharpness detection system of claim 1, wherein surfaces within the sharpness sensing volume are coated or treated to absorb light.

14. The blade sharpness detection system of claim 13, wherein the surfaces within the sharpness sensing volume are coated with a light-absorbing coating.

* * * * *